US005934340A

United States Patent [19]

Anthony, III et al.

[11] Patent Number: 5,934,340

[45] Date of Patent: Aug. 10, 1999

[54] AUTOMATED SPIRAL BINDING MACHINE

[75] Inventors: Philip M. Anthony, III, Chicago; Michael Reiter, Oak Park; Carl Behrend, Chicago; Jerry Fleischfresser, Wheaton; Chris Quatrochi, Homewood, all of Ill.

[73] Assignee: General Binding Corporation, Northbrook, Ill.

[21] Appl. No.: 08/989,013

[22] Filed: Dec. 11, 1997

[51] Int. Cl.[6] ..... B21F 45/16

[52] U.S. Cl. ..... 140/92.94; 140/92.4; 412/38

[58] Field of Search ..... 140/92.7, 92, 93, 140/92.94, 92.4; 412/38, 39, 40

[56] References Cited

U.S. PATENT DOCUMENTS

| | | | |
|---|---|---|---|
| D. 365,580 | 12/1995 | Stiles et al. | D15/128 |
| D. 376,607 | 12/1996 | Mar et al. | D15/127 |
| 2,051,183 | 8/1936 | Schade | 281/16 |
| 2,051,477 | 8/1936 | Grumbacher | 281/25 |
| 2,051,738 | 8/1936 | Ottinger | 129/1 |
| 2,058,272 | 10/1936 | Taylor | 281/25 |
| 2,061,677 | 11/1936 | Schade | 281/25 |
| 2,071,766 | 2/1937 | Schade | 281/25 |
| 2,078,988 | 5/1937 | Amato | 129/23 |
| 2,097,888 | 11/1937 | Leyerle | 11/1 |
| 2,101,804 | 12/1937 | Bidwell | 11/1 |
| 2,107,217 | 2/1938 | Salsman et al. | 11/1 |
| 2,112,389 | 3/1938 | Trussell | 281/25 |
| 2,112,991 | 4/1938 | Madden | 140/92.93 |
| 2,116,589 | 5/1938 | Trussell | 281/25 |
| 2,134,400 | 10/1938 | Grumbacher | 129/1 |
| 2,136,773 | 11/1938 | Hanna | 11/1 |
| 2,136,878 | 11/1938 | Grumbacher | 281/25 |
| 2,142,817 | 1/1939 | Gudis | 281/25 |
| 2,144,581 | 1/1939 | Trussel | 281/25 |
| 2,156,683 | 5/1939 | Dunwoodie, Sr. | 281/25 |
| 2,166,519 | 7/1939 | Catini | 140/92.93 |
| 2,181,662 | 11/1939 | MacDonnell | 281/25 |
| 2,185,004 | 12/1939 | Trussell | 281/25 |
| 2,188,680 | 1/1940 | Farkas | 129/1 |
| 2,193,348 | 3/1940 | Schade | 281/25 |
| 2,216,706 | 10/1940 | Freundlich | 281/25 |
| 2,228,110 | 1/1941 | Grumbacher | 16/180 |
| 2,228,355 | 1/1941 | Key | 129/1 |
| 2,236,169 | 3/1941 | Dunwoodie, Sr. | 281/25 |
| 2,327,941 | 8/1943 | Tauber | 281/21 |
| 2,336,856 | 12/1943 | Freundlich | 281/21 |
| 2,555,290 | 5/1951 | November | 281/25 |
| 2,638,609 | 5/1953 | Penner | 11/1 |
| 2,764,162 | 9/1956 | Valla | 129/1 |
| 2,961,012 | 11/1960 | Freundlich | 140/92.3 |
| 2,963,049 | 12/1960 | Biel et al. | 140/92.3 |
| 2,995,157 | 8/1961 | Catini | 140/92.7 |
| 3,122,761 | 3/1964 | Bouvier | 11/1 |
| 3,193,136 | 7/1965 | Stumpf et al. | 221/40 |
| 3,334,918 | 8/1967 | Pigna et al. | 281/25 |

(List continued on next page.)

FOREIGN PATENT DOCUMENTS

| | | |
|---|---|---|
| 717238 | 9/1965 | Canada . |
| 1168073 | 12/1958 | France . |
| 334662 | 1/1959 | Switzerland . |
| 2044676 | 10/1980 | United Kingdom . |

*Primary Examiner*—Lowell A. Larson
*Attorney, Agent, or Firm*—Leydig, Voit & Mayer

[57] ABSTRACT

A personal binding machine for assembling a preformed coil into a stack of prepunched sheets which includes a loading tube assembly that properly orients the coil to be driven into the stack of sheets, a drive assembly which drives the coil into the stack of sheets, and crimping assemblies for crimping the ends of the coil once inserted into the sheets. The drive assembly includes a three surface contact system having a coil guide substantially adjacent the edge of the stack of sheets, a drive roller and an idler roller. While the coil guide is stationary within the housing, the location of the drive and idler rollers may be adjusted via a camming system to accommodate various coil sizes. The crimping assemblies include a cradle and blade mechanism wherein the blade presses an end of the coil into a cradle to bend or crimp the end. The drive roller may alternately be directly accessed to manually drive the coil through a stack of sheets.

50 Claims, 16 Drawing Sheets

U.S. PATENT DOCUMENTS

| | | | |
|---|---|---|---|
| 3,367,649 | 2/1968 | Thomas et al. | 271/10 |
| 3,459,242 | 8/1969 | Schmidt | 140/92.93 |
| 3,467,150 | 9/1969 | Ostermeier | 140/92.94 |
| 3,486,537 | 12/1969 | Sickinger | 140/92.94 |
| 3,526,415 | 9/1970 | Freundlich | 281/21 |
| 3,568,729 | 3/1971 | Freundlich et al. | 140/103 |
| 3,592,242 | 7/1971 | Sickinger | 140/92.94 |
| 3,793,660 | 2/1974 | Sims | 11/1 |
| 3,818,954 | 6/1974 | Pfaffle | 140/92.3 |
| 3,826,290 | 7/1974 | Pfaffle | 140/92.7 |
| 3,889,309 | 6/1975 | Adams et al. | 11/1 |
| 3,924,664 | 12/1975 | Pfaffle | 140/92.7 |
| 3,967,336 | 7/1976 | Cutter | 11/1 |
| 3,972,109 | 8/1976 | Sickinger | 29/434 |
| 4,095,623 | 6/1978 | Lemburg et al. | 140/92.7 |
| 4,129,156 | 12/1978 | Pfaffle | 140/92.4 |
| 4,129,913 | 12/1978 | Pfaffle | 11/1 |
| 4,143,686 | 3/1979 | Sickinger et al. | 140/92.93 |
| 4,153,081 | 5/1979 | Lemburg et al. | 140/92.7 |
| 4,157,821 | 6/1979 | Fabrig | 270/53 |
| 4,161,196 | 7/1979 | Fabrig | 140/92.4 |
| 4,165,766 | 8/1979 | Fabrig | 140/92.7 |
| 4,185,668 | 1/1980 | Harbert | 140/92.4 |
| 4,208,750 | 6/1980 | Pfaffle | 11/1 |
| 4,232,858 | 11/1980 | Fabrig | 270/53 |
| 4,249,278 | 2/1981 | Pfaffle | 11/1 A |
| 4,253,499 | 3/1981 | Lemburg et al. | 140/92.7 |
| 4,378,822 | 4/1983 | Morris | 140/92.3 |
| 4,403,896 | 9/1983 | Fabrig | 412/38 |
| 4,501,304 | 2/1985 | Lehmann | 140/103 |
| 4,545,603 | 10/1985 | Henes et al. | 281/21 A |
| 4,607,993 | 8/1986 | Scharer | 412/40 |
| 4,609,206 | 9/1986 | O'Brien | 281/33 |
| 4,758,125 | 7/1988 | Wahl | 412/39 |
| 4,773,787 | 9/1988 | Chang | 402/60 |
| 4,874,279 | 10/1989 | Pfaffle | 412/39 |
| 4,907,905 | 3/1990 | Fournier | 402/80 R |
| 5,211,522 | 5/1993 | Ho | 412/16 |
| 5,584,632 | 12/1996 | Stiles et al. | 412/39 |
| 5,695,308 | 12/1997 | Hastings et al. | 412/39 |

AUTOMATED SPIRAL BINDING MACHINE

FIELD OF THE INVENTION

The invention relates generally to spiral binding machines, and more specifically to a personal machine for feeding a spiral coil through prepunched holes in sheets of paper.

BACKGROUND OF THE INVENTION

Machines for spirally binding sheets of paper on a commercial scale are generally known in the art. For example, U.S. Pat. No. 4,378,822, issued Apr. 5, 1983, discloses driving a spiral coil between a mandrel and a drive wheel. The drive wheel and the mandrel are disposed along one edge of the stack of sheets to be bound. However, the mandrel guides the coil only until the coil actually commences to spirally engage the punched holes of the sheets. Accordingly, a critical difficulty in this type of arrangement is reliably guiding the spiral feed of the coil along the length of the papers and through the punched holes in the sheets.

Another device that has been used to guide the feed of a spiral coil into engagement with prepunched holes in a stack of sheets is a coiling tool, such as is described in U.S. Pat. No. 3,592,242, issued Jul. 15, 1971. The coiling tool includes a mandrel which is surrounded by slotted member. Wire enters the slotted member at one end, is coiled by the mandrel and exits at the opposite end of the tool in the form of a wire which, as it turns feeds successively through the series of punched holes in the sheet stack. While guide members may be disposed along the length of the punched hole edge of the sheets to assist in directing the movement of the spiral wire as it spirally winds through the holes in the sheets, there still exists possibilities for jamming or misthreading due to tension build-up along the spiral wire.

Spiral binding machines of this type are relatively large and generally inappropriate for desktop or office use. U.S. Pat. No. 5,785,479, which is likewise assigned to the assignee of this application, is one attempt to provide a desktop spiral binding machine. The disclosed device, however, is still fairly large and includes a movable cartridge for feeding the spiral coil. Yet another device is disclosed in U.S. Pat. No. 5,584,632 to Stiles et al. The Stiles reference uses a feeding mechanism similar to those described above with regard to the commercial scale machines in that the spiral coil is driven into the punched holes of the sheets by a drive wheel at one end of the paper. Accordingly, a critical difficulty in the disclosed arrangement is reliably guiding the spiral feed of the coil through the punched holes along the entire length of the sheets.

OBJECTS OF THE INVENTION

The primary object of the invention is to provide a compact personal binding machine that may be utilized in an office atmosphere to bind a coil into a prepunched stack of sheets to provide a high quality, bound book. A related object is to provide an automated personal binding machine that inserts a coil into a prepunched stack of sheets and crimps both ends of the coil, but minimizes interaction required by the user.

A more particular object is to provide a personal binding machine that is easy to use and provides visual indications to a user to direct proper operation of the machine, including the loading of an appropriate sized coil for binding a particular stack of sheets.

Another object is to provide an automated binding machine that requires a minimum of desktop space for usage.

A further object of the invention is to provide a reliable automated personal binding machine which consistently performs the operation of assembling a coil into a stack of sheets and consistently crimping the ends of the coil.

Yet another object of the invention is the provide a personal binding machine that may be used to coil bind stacks of sheets of a variety of sizes and thicknesses.

A related object is to provide a personal binding machine that may be used to automatically bind stacks of sheets of within various given standard size ranges, or manually bind stacks of sheets of larger size or greater thickness than such standard sizes.

BRIEF SUMMARY OF THE INVENTION

In accomplishing these and other objects of the invention, there is provided a personal binding machine for inserting a preformed coil into successive openings in a stack of prepunched sheets and a method for performing such operations. The machine is preferably operated by means of a microprocessor which receives signals from various sensors and directs the operations of the machine. The machine includes, generally, a pin assembly for properly positioning the stack of sheets for insertion of the coil, a coil loading assembly for properly positioning an appropriately sized coil to be driven into the stack, a drive assembly for driving the coil into the stack, and crimping assemblies for crimping the lead and trailing ends of the coil to hold it into position once it has been inserted into the stack. Preferably, the location of the components of the pin assembly and the drive assembly are cam operated by a cam assembly.

During use, the prepunched openings of the stack of sheets are disposed over upright pins of the pin assembly. The machine has a housing with a large first lid to which an optical sensor assembly is mounted for sensing the height of the stack of sheets and to provide visual indication to the user along a display assembly located in the upper portion of the housing by sending a signal through the microprocessor. The user then loads an appropriately sized coil into the entry port of the coil loading tube assembly. According to another aspect of the invention, a series of bends within the loading tube, including an orientation bend, substantially adjacent to the outlet of the opening properly positions the coil to be driven into the stack of sheets by the drive assembly.

As the coil is loaded into the loading tube, it depresses the widened surface of a lever which actuates optical sensors that indicate the size of the loaded coil. The microprocessor compares this signal to the size of coil required to bind the stack of sheets and provides a visual indication to the user on the display assembly if the coil is of an inadequate size. As the coil emerges from the outlet of the loading tube, it actuates yet another sensor (the "ready" sensor) which indicates that the coil is ready to be inserted into the stack, provided an appropriate size coil has been loaded by being sensed by the microprocessor which in turn displays on the display assembly that the coil is ready to be inserted into the stack.

The drive assembly includes three elongated contact surfaces disposed peripherally about the coil; the lines of contact between the contact surfaces and the coil extend the length of the coil as it is driven into the prepunched openings of the sheets. The first contact surface is a coil guide which is disposed substantially adjacent to the edge of the sheets to be bound and includes a series of helical grooves and tines which receive the coil as it progresses through the stack of sheets. The second and third support surfaces are the idler and drive rollers.

While the coil guide is stationary, the positions of the idler and drive rollers are determined by the size of the coil loaded into the loading tube. When the user depresses a start button (after both a stack of sheets and a coil have been properly loaded), the microprocessor provides an indication to a gear motor coupled to a cam shaft to rotate the shaft. Rotation of the cam shaft, first, rotates a pin assembly actuation cam, which causes the pin assembly to withdraw the pins from the prepunched holes of the stack of sheets, and second, rotates the drive cams coupled thereto to position the idler and drive rollers of the drive assembly an appropriate distance and angle from the coil guide to accommodate the loaded coil size.

The microprocessor then directs a drive motor to rotate the drive roller until such time as the trailing end of the coil passes loading sensor. The microprocessor then directs the drive roller to walk the coil forward until the trailing end is appropriately positioned in the trailing crimping assembly, which is indicated by another sensor. The microprocessor then fires the crimping assembly to crimp the trailing end of the coil. The driver roller then advances the coil through the remaining prepunched holes until the lead end of the coil enters the lead end crimping assembly. The lead end crimping assembly is then fired to crimp the lead end of the coil and complete the book.

According to another feature of the invention, the crimping assemblies operate by means of a blade and cradle mechanism. The end of the coil is positioned in front of a recess or cradle. An edge of a blade is then rapidly advanced into the cradle to bend the coil into the shape of the cradle.

When a completed book is removed from the machine, each of the assemblies return to its home position. That is, the pins move to the upright position for engagement with a new stack of sheets, and the idler and drive rollers move to disengaged positions.

According to yet another feature of the invention, if the user wishes to manually insert coil into a stack of prepunched sheets, the drive roller in its home position may be directly accessed through an opening in the first lid of the housing. When the first lid is closed and the second lid is opened and the sensor in the lid does not sense the presence of a stack of sheets, the drive motor rotates the drive roller in its home position, disengaged position when the start button is actuated. In this way, the user can hold a coil against the drive roller to manually rotate the coil and insert it into the prepunched holes in the stack of sheets.

DESCRIPTION OF THE PREFERRED EMBODIMENT

Figure 1:
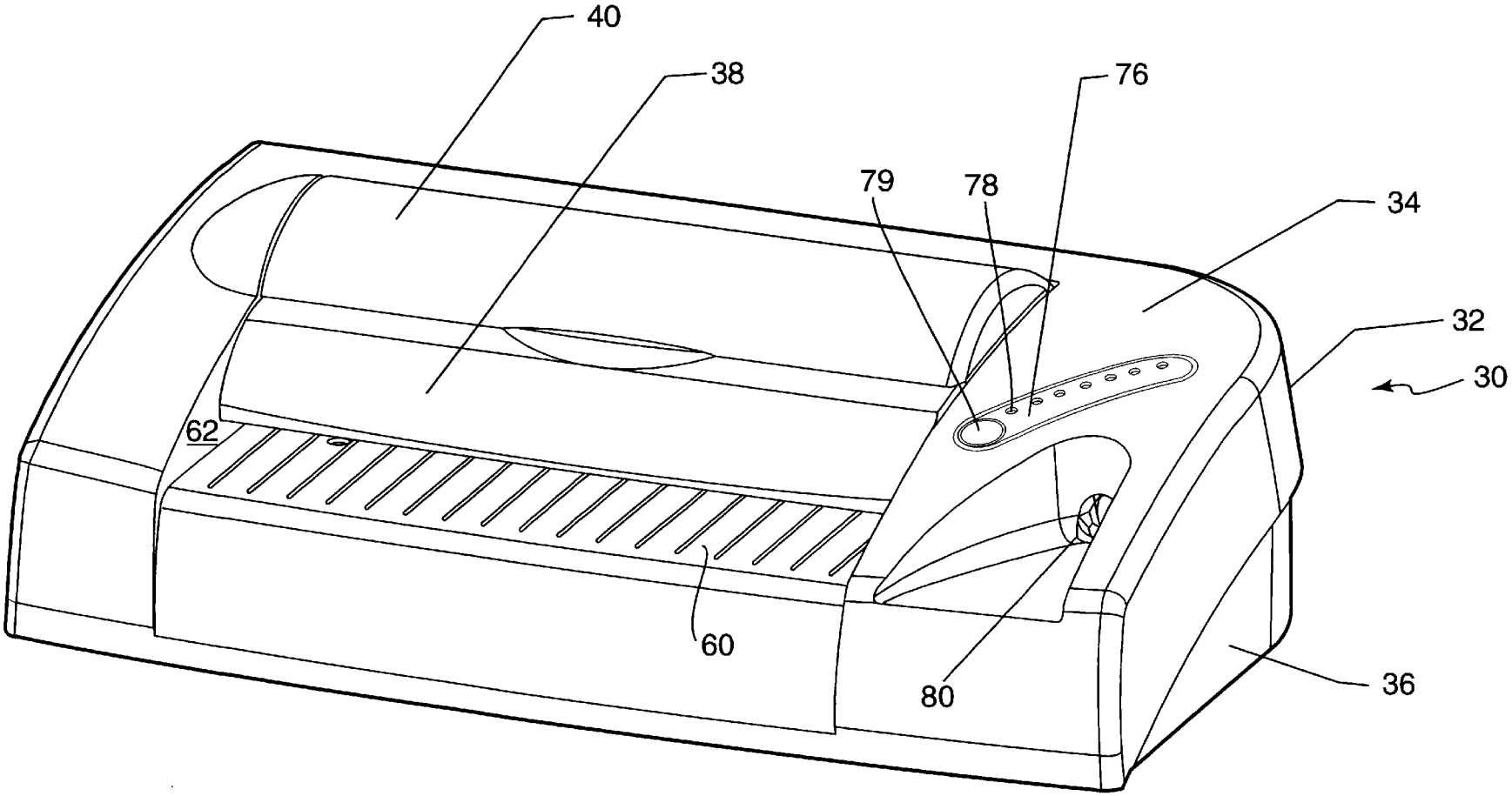
FIG. 1 is a perspective view of an automated machine for spirally binding a coil into a stack of prepunched sheets constructed in accordance with teachings of the invention.
Figure 2:
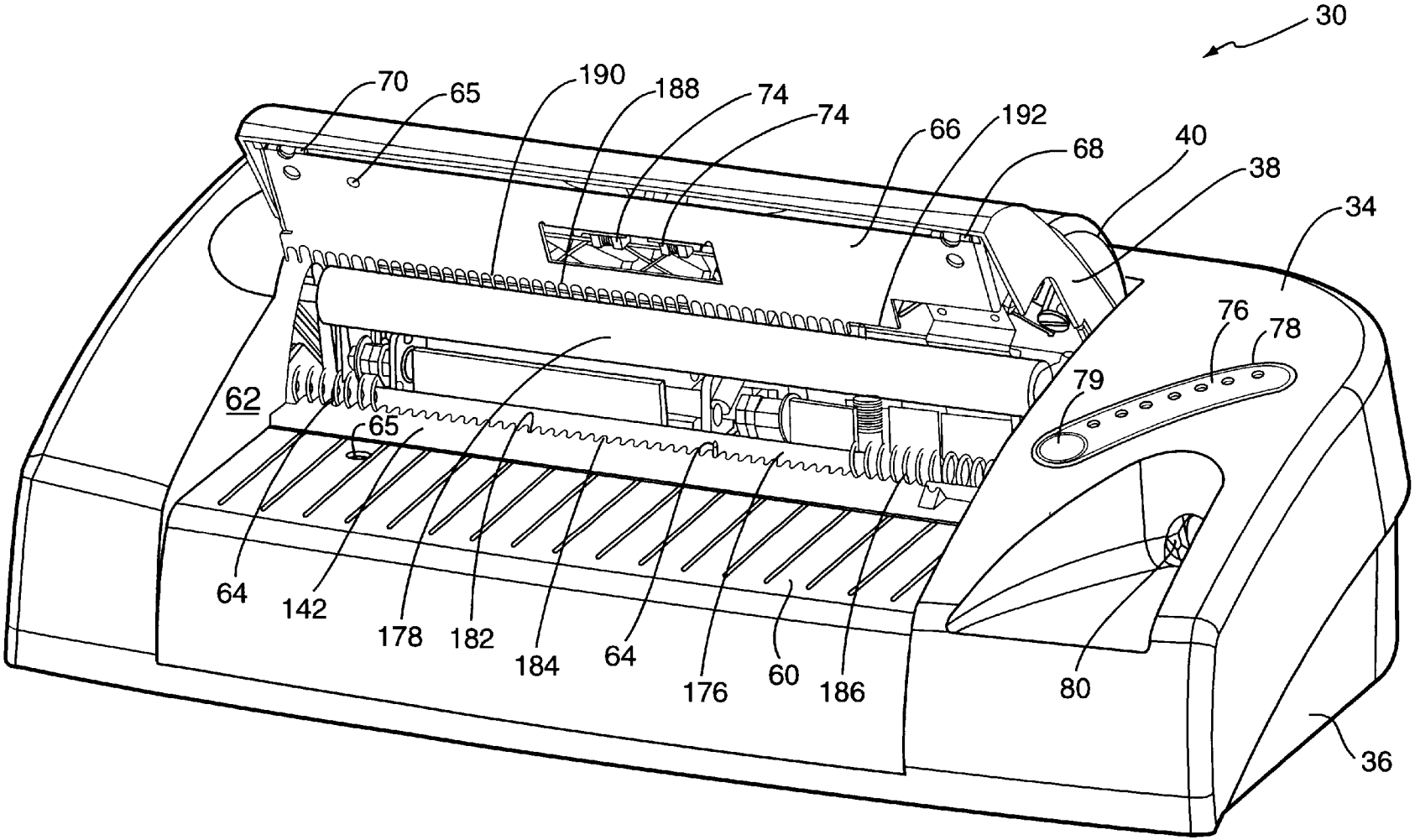
FIG. 2 is the automated machine of FIG. 1 wherein the first lid is in an opened position with segments of coil shown for illustrative purposes only.

Turning now to the drawings, there is shown in FIG. 1 an automated machine for spirally binding a coil into a stack of sheets (not shown) having prepunched holes along a side edge. The machine 30 includes a housing 32 having top and bottom portions 34, 36. The top portion 34 of the housing 32 includes first and second lids 38, 40. As shown in FIG. 2, the first lid is pivotally coupled to the top housing 34 by a pair of hinges 35 or the like such that the first lid 38 may be pivoted to the open position shown in FIG. 2.

Figure 3:
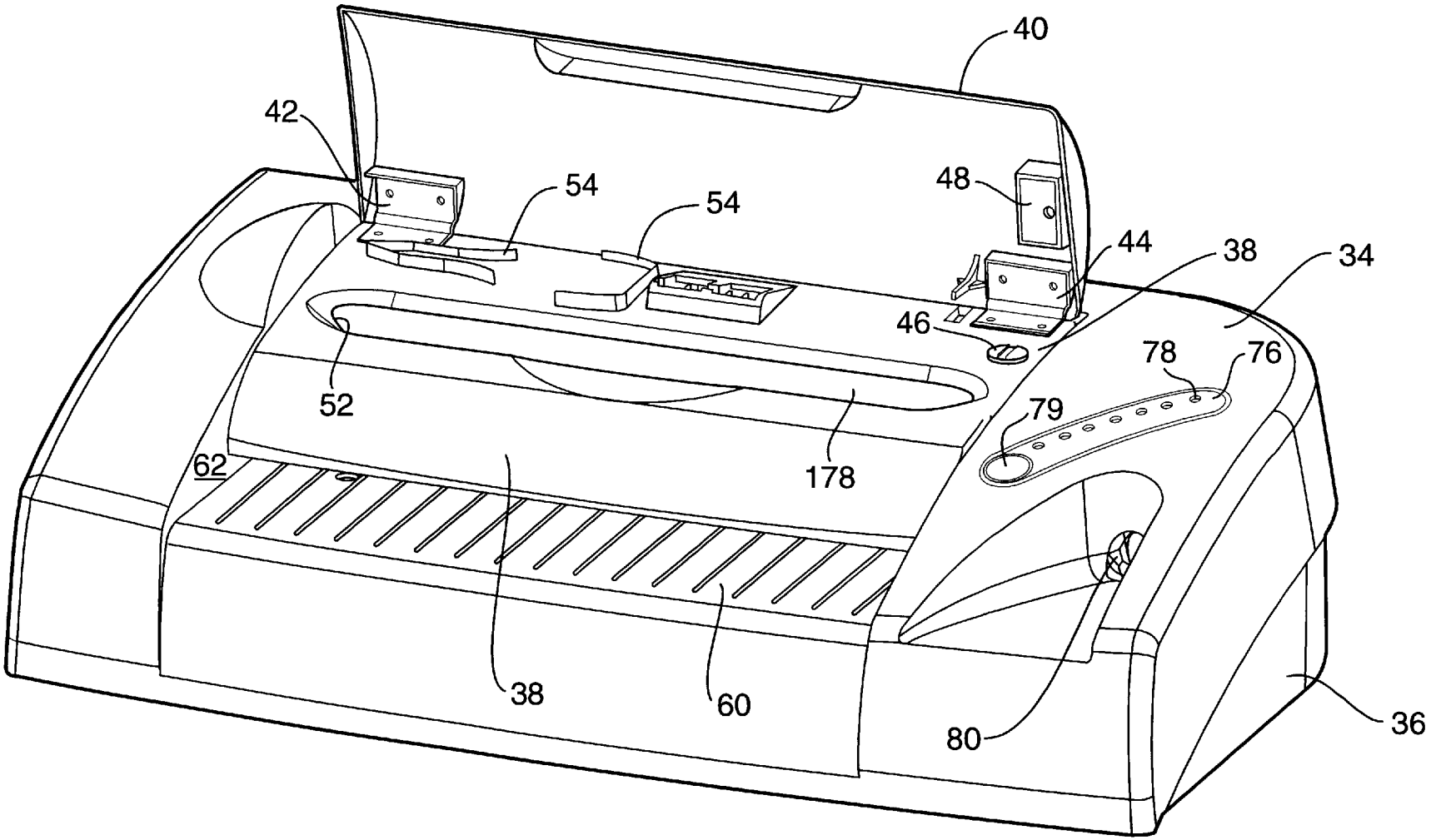
FIG. 3 is the automated machine of FIG. 1 wherein the second lid is in an opened position.

As shown in FIG. 3, the second, preferably smaller lid 40 is similarly pivotally coupled to the top housing portion 34. In this embodiment, the second lid 40 is pivotally coupled to the first lid 38 by a pair of hinges 42, 44 which is in turn pivotally coupled to the top housing 34. In order to maintain the second lid 40 in the closed position against the first lid 38 when the first lid 38 is hinged open to the position shown in FIG. 2, a magnetic coupling is provided. As may be seen in FIG. 3, a magnet 46 is secured to the first lid, while a steel plate 48 is secured to the inner surface of the second lid 40.

According to one aspect of the invention, the machine 30 may be used to automatically insert a coil into a stack of prepunched sheets, or to manually advance a coil through such sheets. As also may be seen in FIGS. 2 and 3, the machine 30 includes a coil drive roller 178 to feed a coil through a stack of prepunched sheets. The coil drive roller 178 may be utilized to feed a coil either manually or automatically. The significance of the coil drive roller 178 with regard to automatic feeding of the coil will become apparent upon further explanation below with regard to the automatic drive assembly.

In order to facilitate access to the drive roller 178 for manual coil insertion, the first lid 38 preferably includes an elongated opening 52 disposed substantially adjacent the drive roller 178. If the user desires to manually insert a coil into a prepunched stack of paper, for example, as when the user desires to bind a longer, or thicker stack of sheets than that for which the particular machine is designed, the user may thread the lead end of the coil through the first two or three holes of a stack of prepunched sheets. The user then opens the second lid 48. In response, the microprocessor engages a drive motor (identified in subsequent drawings as 220, as will be described below) to turn on the coil drive roller 178. Holding the coil against the rotating drive roller 178, the drive roller 178 will pull the coil into the prepunched holes. Once assembled into the paper, the ends of the coil may then be manually crimped to prevent the coil from uncoiling from the paper. In this regard, a separate hand tool (not shown) of any known design may be provided for crimping the ends of the coil. As shown in FIG. 3, the machine may be provided with ridges 54 which may hold the tool in position on the machine when not in use.

Figure 7:
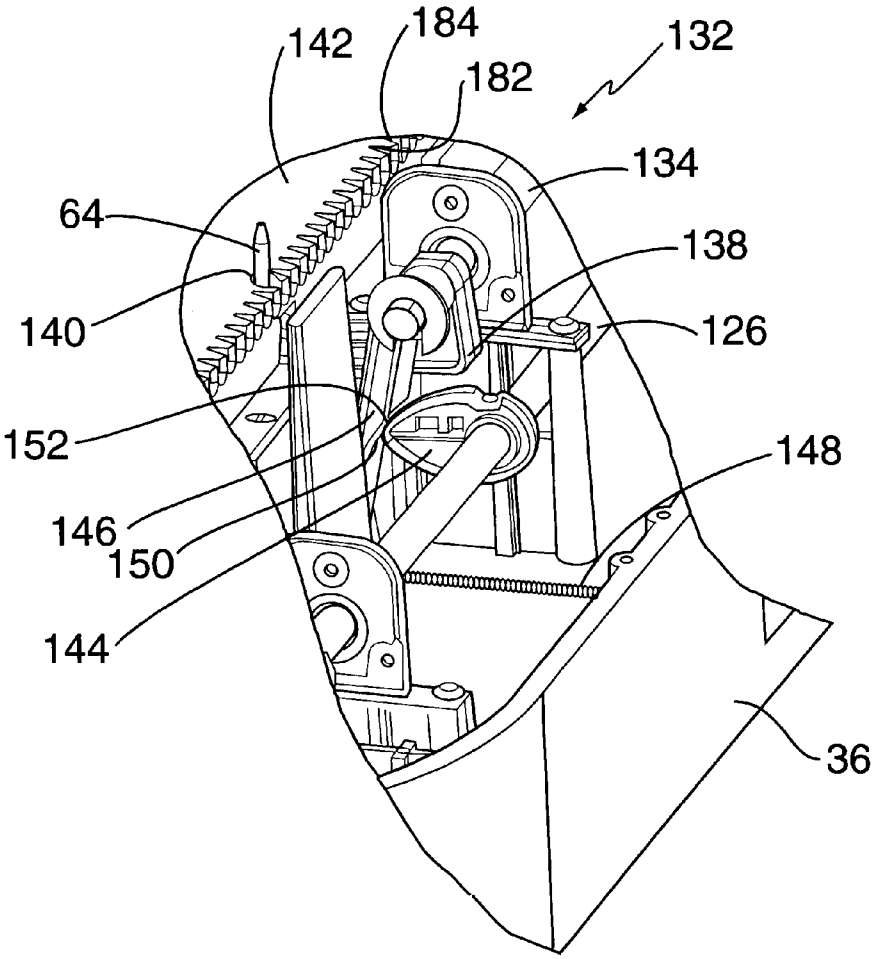
FIG. 7 is an enlarged fragmentary perspective view of the pin assembly of FIG. 6 and a fragmentary portion of the cam shaft assembly wherein the pins are shown in the engaged position.

Returning now to FIG. 2, there is shown a support surface 60 for supporting a stack of prepunched paper (not shown) to be spirally bound by the automated process. In order to load the stack of paper into position on the support surface 60, the first lid 38 is hinged to the open position shown in FIG. 2. A coil guide 142, the significance of which will become apparent upon further explanation is provided along the inner edge of the support surface 60. In order to properly position the stack of paper on the support surface 60, there is provided at least one upstanding pin 64 extending through or substantially adjacent to the coil guide 142. In the 25 preferred embodiment illustrated, a pair of pins 64 are provided. As shown in FIG. 7, in order to orient the stack of paper such that the channel formed by the prepunched holes in the stack of paper simulate the curve of a coil, the pins 64 have an arcuate shape. The user positions the stack of sheets to be bound over the pins 64 on the support surface 60 adjacent the vertical surface 62 of the top housing.

In order to maintain the stack of sheets in the desired position, an upper comb plate 66 is pivotally coupled to the first lid 38 at hinge points 68, 70 (see FIG. 2). Once the stack of sheets is in the proper position, the first lid 38 is lowered to the position shown in FIG. 1. Those skilled in the art will appreciate that when the first lid 38 is lowered, the upper comb plate 66 holds a stack of paper in position for feeding of a coil, when the orientation pins 64 are in an engaged position within the prepunched holes, as well as when the orientation pins 64 are disengaged, or withdrawn from the holes.

Closing the first lid 38 actuates a paper sensor 65 preferably disposed within the first lid 38. If the paper sensor 65 reads the presence of paper, the microprocessor then reads the amount of paper to determine the proper coil size to use.

In addition, in order to identify the smallest diameter of coil required to bind the stack of papers, at least one optical sensor 74 is provided in the upper comb plate 66. As the first lid 38 is lowered to the stack of papers, the optical sensor 74 identifies the thickness of the stack of sheets. A signal identifying the thickness of the stack, as well as the presence of paper is transmitted to a microprocessor of standard design (shown schematically as a box 75 in FIG. 4), and on to a display assembly 76 disposed along the surface of the top housing 34 (see FIGS. 1, 3). The display assembly 76 includes a series of lights 78 which identify relevant information to the user as well as a "start" button 79. Upon receiving a signal from the microprocessor 75, a light 78 in the display assembly 76 illuminates to identify to the user the minimum coil size required to bind the loaded stack of sheets.

Figure 4:
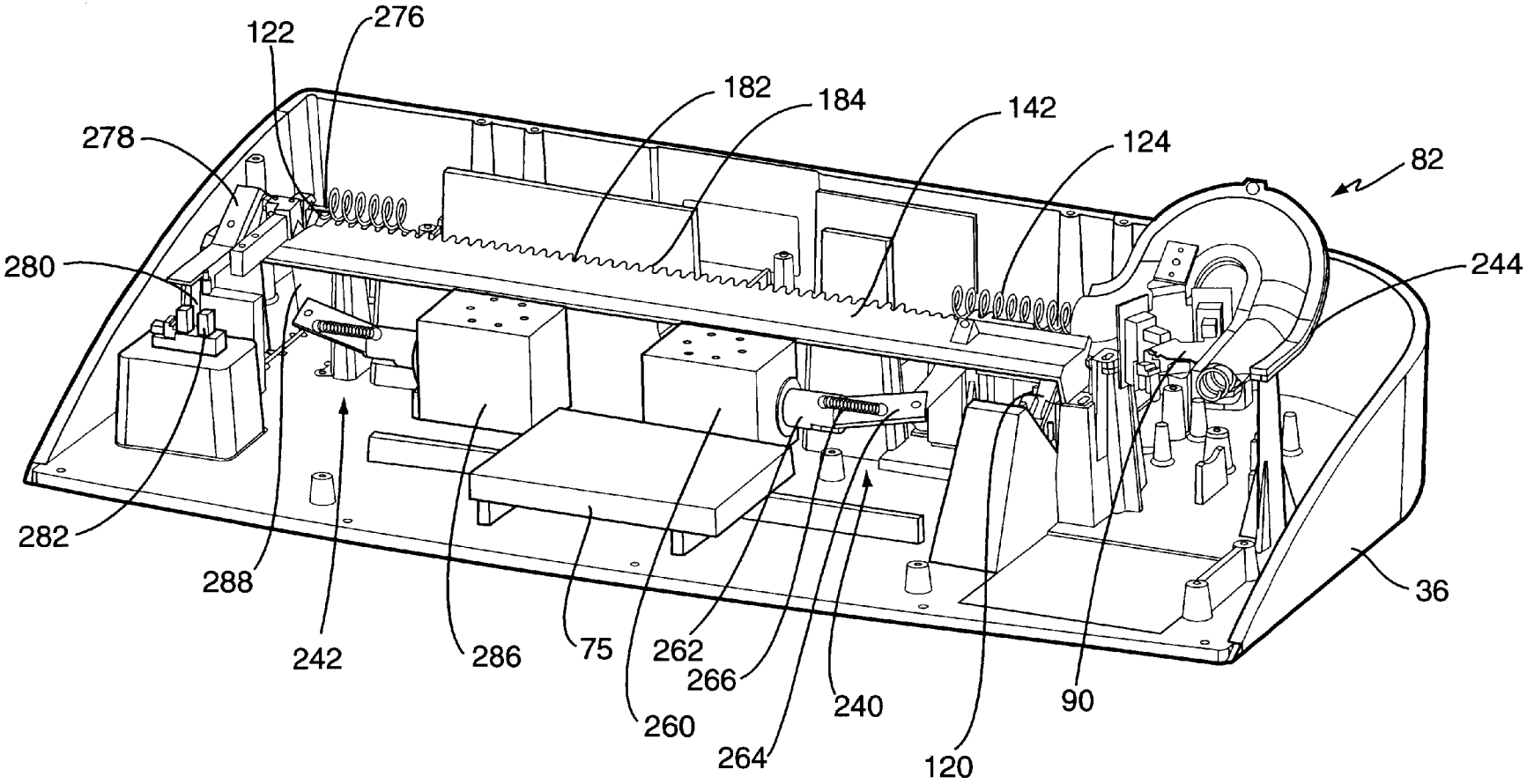
FIG. 4 is a front perspective view of the coil loading tube assembly and the crimping assemblies of the automated machine of FIG. 1 wherein segments of a coil are shown for purposes of illustration only.

Once the user visually identifies the appropriate coil size, the user feeds a coil into the entry port 80 of the coil loading tube assembly 82, which is secured to the housing 32, in this embodiment, the bottom housing portion 36 as shown in FIG. 4. (The coil loading tube assembly 82 is shown in greater detail in FIG. 5, which is partially broken away at the entry port 80.) While the entry port 80 preferably opens along the front surface of the top housing 34 as shown in FIGS. 1–3, it will be appreciated that the entry port 80 could alternately open along the side surface of the housing 32 or along an alternate point along the top or bottom housing 34, 36.

The coil loading tube assembly 82 includes a hollow coil loading tube 86 that forms an internal passage 88 which extends from the entry port 80 at a guidably shaped pocket or coil guide to an outlet 110 substantially adjacent a support surface of the drive assembly (as will be explained below). For purposes of explanation, a coil identified generally at 84 is shown loaded into the internal passage 88 of the tube assembly 82. The path of the coil 84 through the internal passage 88 of the coil loading tube 88 is indicated by a pair of parallel dotted lines.

In order to ensure that the user has selected and loaded a coil 84 which is of a sufficient size to bind a loaded stack of papers, the coil loading tube assembly 82 is provided with a size indication assembly 90. The size indication assembly 90 includes a lever 92 and one or more optical sensors 94. The lever 92 is pivotally coupled to the loading tube 86 by a pin 96 and disposed within an axially extending opening 98 in the tube 86 such that the lever 92 pivots relative to the tube 86 as a coil 84 is loaded into the internal passage 88 of the loading tube 86. In this regard, the lever 92 is provided with a widened surface 100 for contact with the coil 84. When no coil is loaded into the internal passage 88 of the tube 86, the lever 92 is spring biased into the position shown in phantom in FIG. 5.

Figure 5:
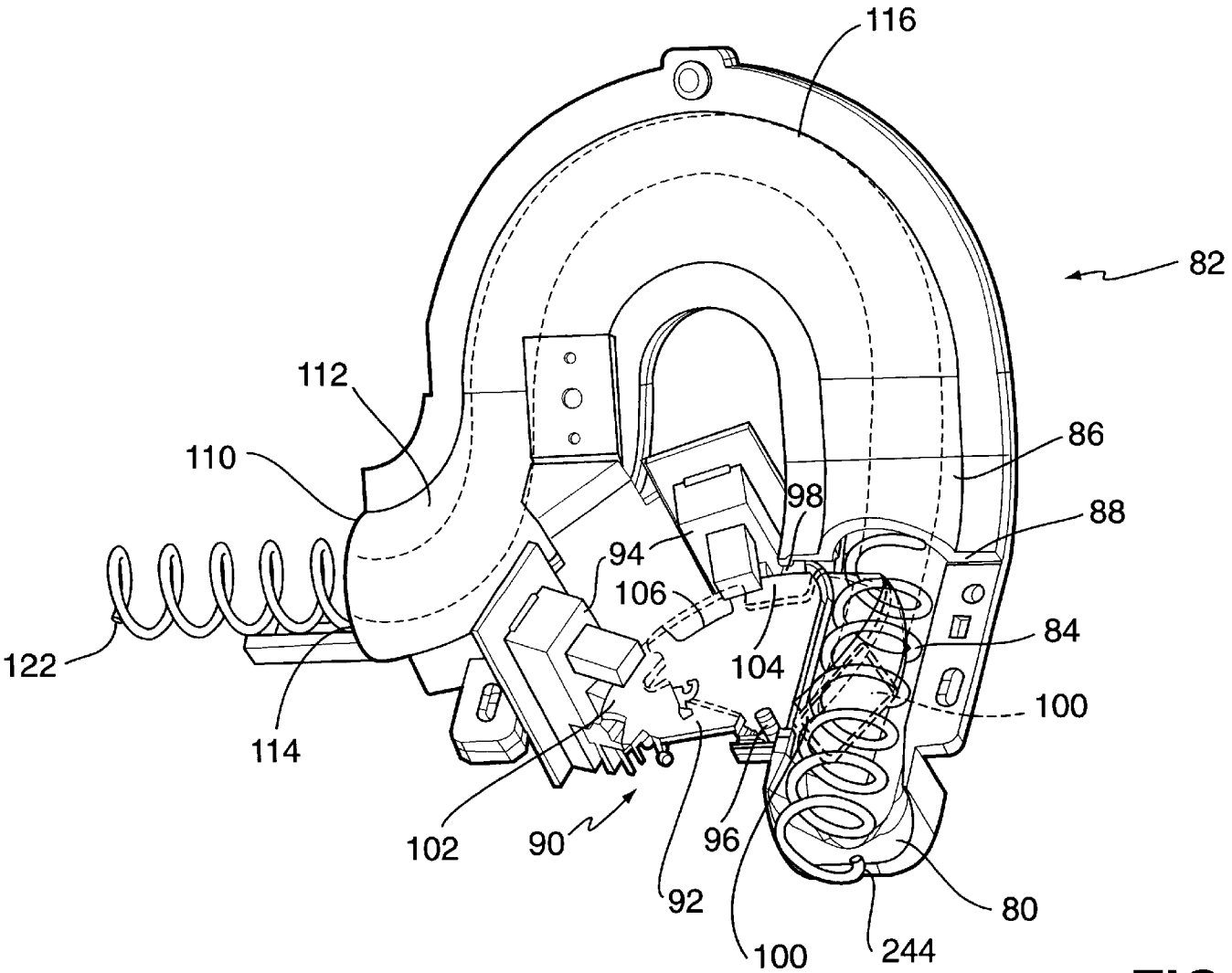
FIG. 5 is a fragmentary perspective view of the coil loading tube assembly partially broken away to show the size indication assembly with a segment of coil shown for purposes of illustration only.

As a coil 84 is loaded into the internal passage 88, the coil 84 exerts a force against the widened surface 100 to pivot the lever 92 to the position in solid lines in FIG. 5. As the lever 92 pivots, it moves through optical sensors 94 (preferably two sensors as shown here) of standard design to identify the size of coil 84 loaded into the tube 86. In the embodiment illustrated, the lever includes two flags 102, 104 separated by a recess 106. It will be appreciated by those skilled in the art that as the lever 92 pivots through the optical sensors 94, the optical sensors sense the relative location of the flags 102, 104 and the recess 106 to identify the size of coil loaded within the tube 86. The optical sensors 94 then provide a signal to the microprocessor 75, which compares the size of the coil 84 loaded into the tube 86 with the size of coil required by the thickness of the paper stack (as sensed by the optical sensor 74 along the upper comb plate 66). If the coil 84 inserted into the tube 86 is smaller than required to bind the stack of papers, a warning light 78 will illuminate along the display assembly 76 to indicate that an incorrect size has been loaded.

The opposite end 110 of the tube 86 opens substantially adjacent the coil insertion assembly. In order to position the coil for proper engagement of the coil insertion assembly, the loading tube 86 includes an orientation bend 112 substantially adjacent the outlet 110 of the internal passage 88 of the loading tube 86. According to an important feature of the invention, as the coil 84 advances through the internal passage 88, the coil 84 contacts the wall of the passage 88 to bias the coil 84 along the edge 114 as the coil 84 emerges from the passage 88. In this way, the coil 84 may be consistently positioned in the desired location for engagement with the coil insertion assembly regardless of coil size.

To facilitate loading the coil 84 from the front surface of the housing 32, the loading tube 86 also preferably includes a bend 116 which positions the coil 84 to enter the orientation bend 112. As illustrated in the preferred embodiment shown in FIG. 5, the bend 116 is on the order of 180°, while the orientation bend 112 is on the order of 90°. It will be appreciated, however, that these bends 116, 112 may be of alternate angles so long as the orientation bend 112 positions the coil 84 into the desired biased position.

Figure 16:
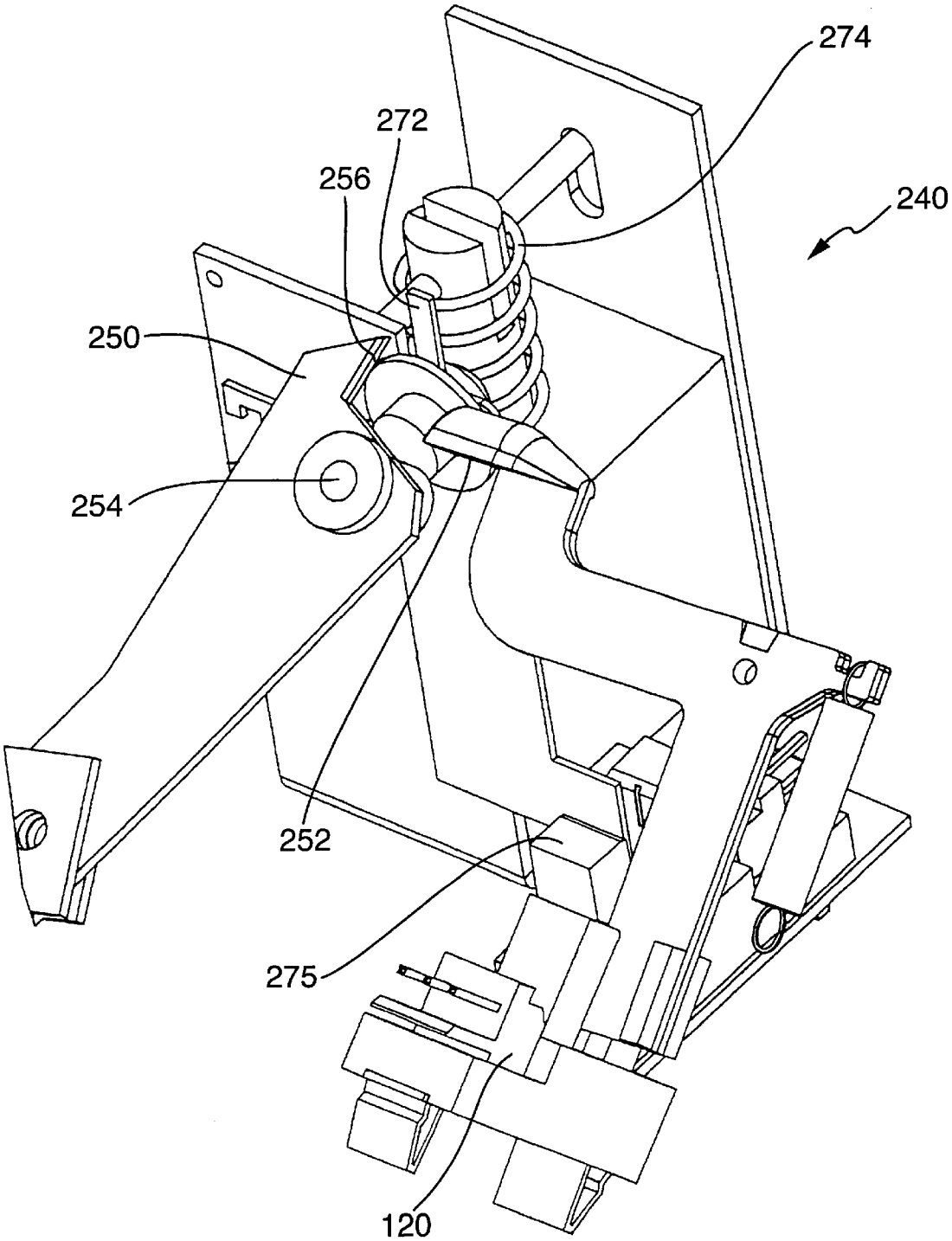
FIG. 16 is an enlarged fragmentary perspective view of the trailing end crimping assembly shown in FIGS. 15 and 4.

To identify when the coil is in the proper position for entry into the positioned stack of sheets, a sensor 120 is provided substantially adjacent the outlet 110, as shown in FIGS. 4 and 16. In the embodiment illustrated, the sensor 120 is activated by a whaleback flag 252. To actuate the sensor, the user advances the coil 84 through the internal passage 88 of the loading tube 86 and through the outlet 110. The user then pushes the coil far enough to advance the lead end 122 of the coil beneath a locating finger 124 (shown in FIG. 6) to actuate the whaleback flag 252 which trips the sensor 120. It will be appreciated that as the coil 84 moves forward to bind the stack of sheets, the whaleback sensor will remain tripped until the trailing end 244 of the coil passes by the whaleback flag 252 and sensor 120. When the proper size coil 84 is loaded into the ready position and actuates the whaleback sensor 120, a ready light 78 will illuminate along the display assembly 76.

Once the ready light 78 is illuminated and the user depresses the start button 79, the remainder of the assembly process proceeds automatically. In this regard, the assembly process generally proceeds as follows: the gear motor 160 (shown in FIG. 10) rotates the cam shaft 126 which in turn simultaneously retracts the pins 64 from the prepunched holes (see FIGS. 6–8) and sets the idler and drive rollers 176 and 178 in their proper position; the drive roller 178 is then oriented on top of the coil 84; the motor 220 is then actuated so that the drive assembly pulls the coil through the prepunched holes of the sheets (see FIGS. 11–14); and, finally, a pair of crimping assemblies 240, 242 crimp each end of the coil (see FIGS. 4 and 16). Each of these assemblies will be addressed in order below.

Figure 6:
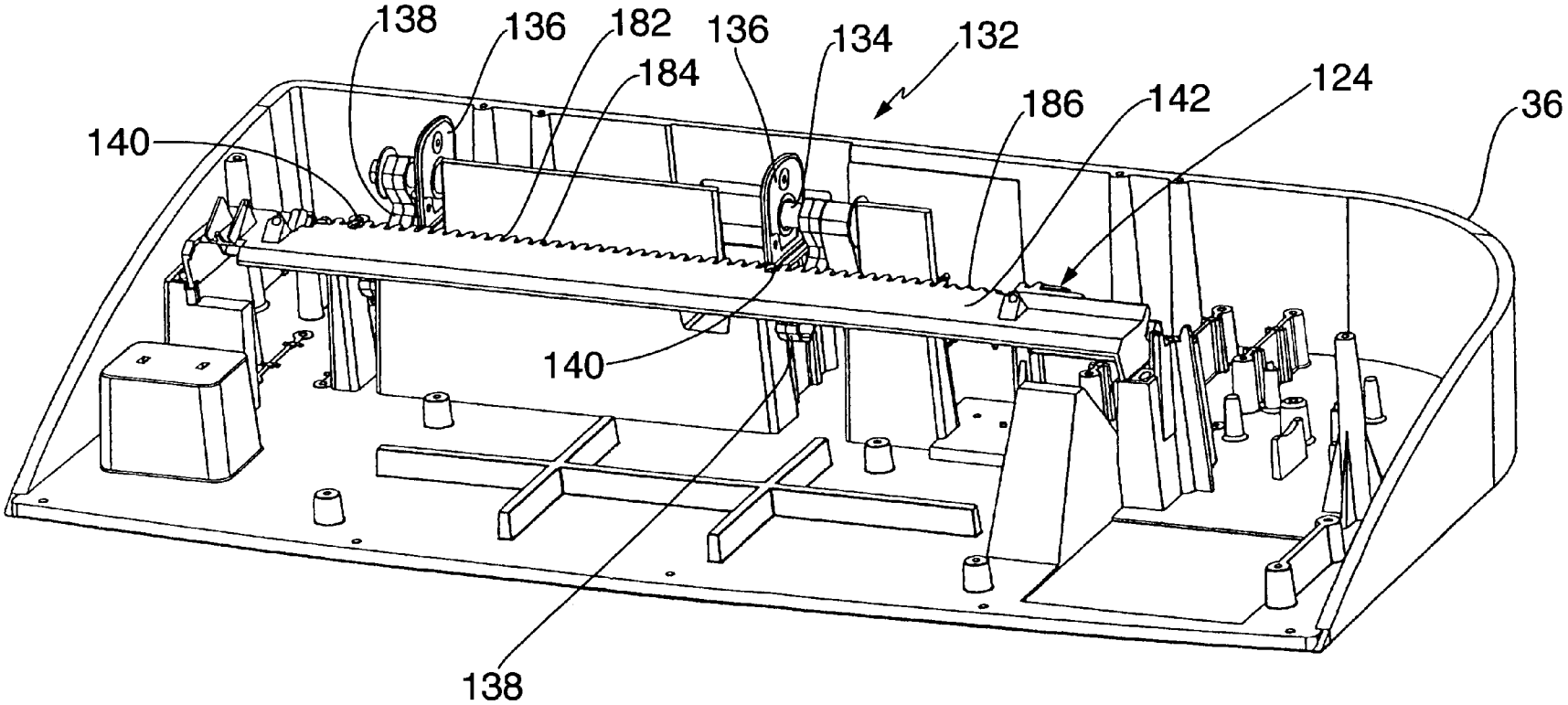
FIG. 6 is a fragmentary perspective view of the automated machine of FIG. 1 showing the pin shaft assembly with the pins in the disengaged position.
Figure 8:
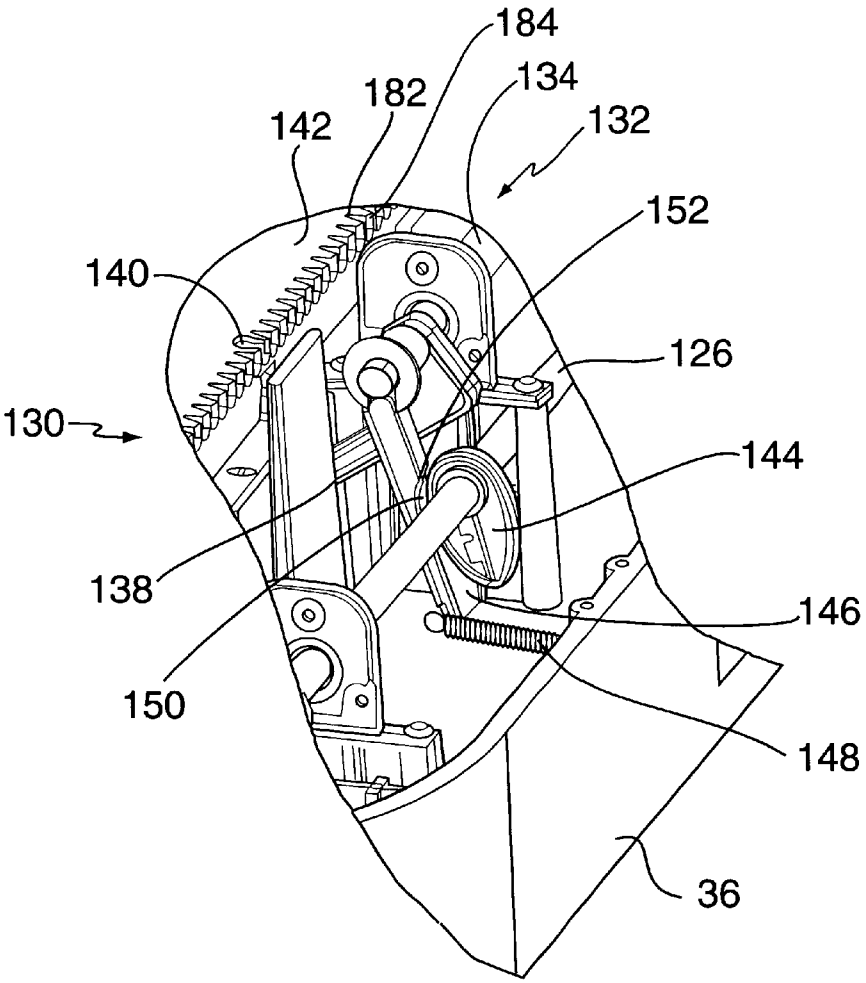
FIG. 8 is an enlarged fragmentary perspective view of the pin assembly of FIG. 6 and a fragmentary portion of the cam shaft assembly wherein the pins are shown in the disengaged position.

Turning first to the pin assembly 132, the pin shaft assembly is shown in greater detail in FIGS. 6, 7, and 8. The pin shaft assembly 132 includes a pin shaft 134 which is rotatably coupled to the bottom housing 36 by a pair of upright supports 136. The pins 64 (visible in FIG. 7) are coupled to the pin shaft 134 and secured for rotation therewith by pin arms 138. As may be seen generally in FIG. 7, when the pin arms are in a generally horizontal engaged position, the pins 64 extend through openings 140 in the guide assembly 142. Conversely, when the pin arms 138 are pivoted generally downward to the position shown in FIG. 8, the pins 64 do not engage the openings 140, and, accordingly, do not engage the prepunched holes in the stack of paper.

In order to move the pins 64 between the engaged position shown in FIG. 7 and the disengaged position shown in FIG. 8, at least one actuation cam 144 is provided along a cam shaft 126, as may be seen in FIGS. 7 and 8. The cam shaft assembly 128, which is powered by a gear motor 160, is shown in greater detail in FIGS. 9 and 10. To transmit the rotational force of the cam 144 to the pin shaft 134, a downwardly extending actuation arm 146 is secured to the pin shaft 134 for rotation therewith. As shown in FIG. 8, the actuation arm 146 (and, accordingly, the pin shaft assembly 132) is generally biased in the disengaged position by a spring 148, the respective ends of which are coupled to the actuation arm 146 and the bottom housing 36.

The actuation arm 146 is preferably provided with a generally curved cam engagement surface 150. As may be seen in FIG. 7, as the pin actuation cam 144 rotates with the cam shaft 126, the surface of the cam 144 contacts the cam engagement surface 150 to rotate the pin shaft 132 and pivot the pin arms 138 into the engagement position. As the cam 144 continues to rotate (as when the start button is depressed), the cam 144 advances beyond the elbow 152 of the cam engagement surface 150 and the actuation arm 146 and, accordingly, the pins 64 move to the disengaged position shown in FIG. 8 as the spring 148 biases the actuation arm 146 to its disengaged position.

Figure 11:
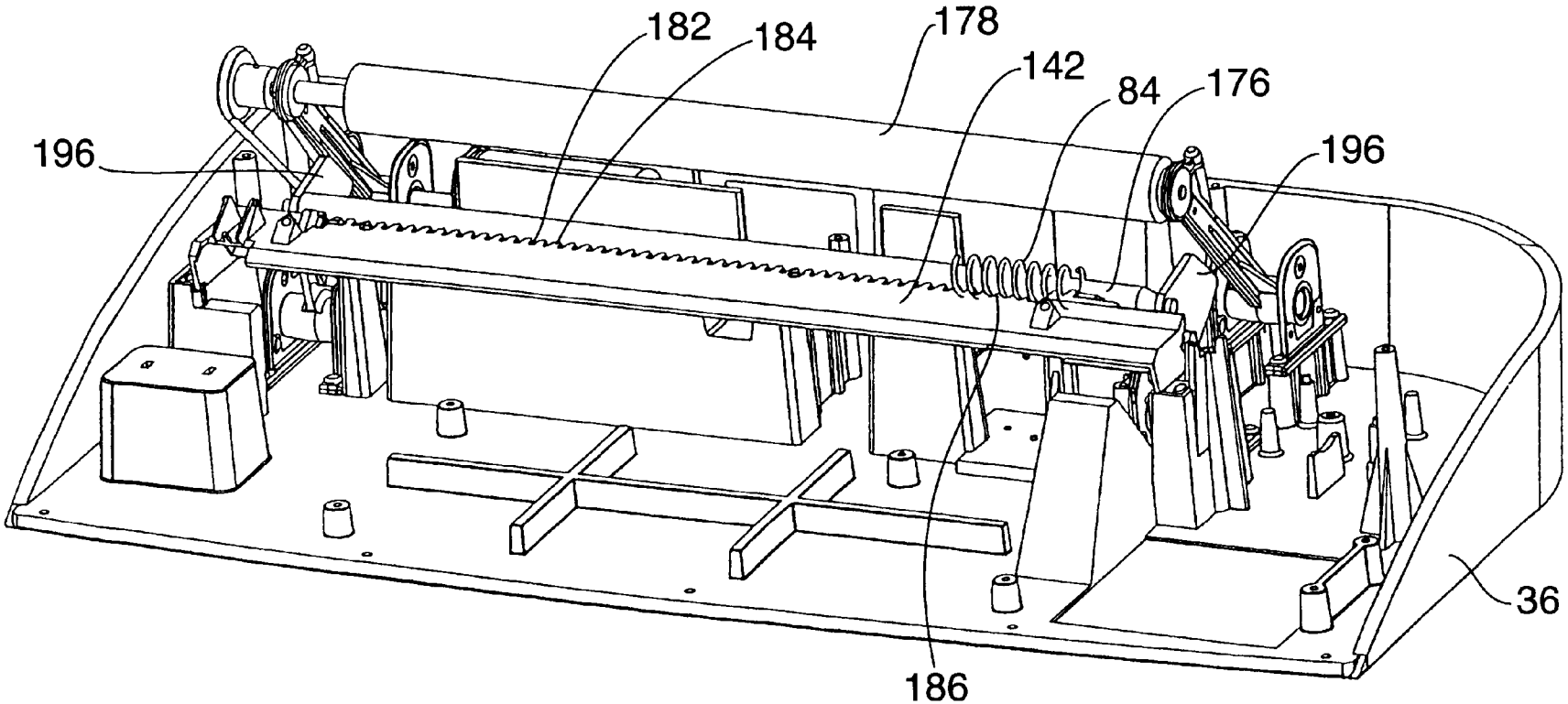
FIG. 11 is a fragmentary perspective view of the automated machine of FIG. 1 showing the drive assembly with a segment of a coil disposed along the coil guide for purposes of illustration only.
Figure 12:
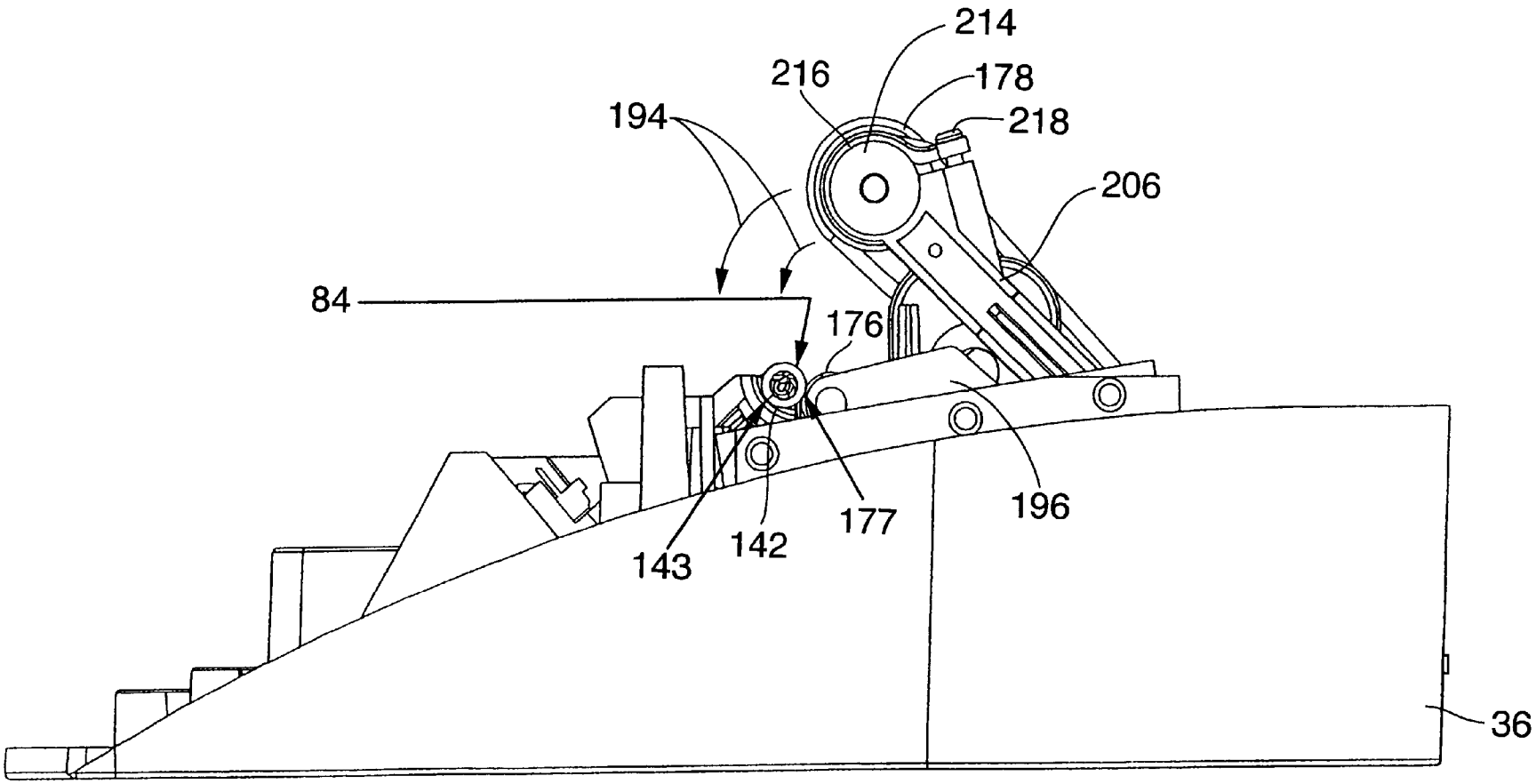
FIG. 12 is a fragmentary end view of the drive assembly of FIG. 10 taken from the right side as viewed in FIG. 11 with a segment of coil shown for purposes of illustration only.

Turning now to the drive assembly shown in FIG. 11, according to an important aspect of the invention, the coil 84 is supported at three support surfaces as it is advanced through the prepunched holes of the paper. The coil 84 is supported by the coil guide 142, an elongated idler roller 176, and the drive roller 178. Each of the three supports are generally parallel and preferably extend substantially the entire length over which a coil 84 would travel as it is advanced through the prepunched holes of a stack of sheets. As a coil is advanced, the three supports contact the coil 84 along three sectors, respectively, about the periphery of the coil 84 as shown in FIG. 12. In this way, the three lines of contact of the support surfaces stabilize and guide the coil 84 as it is inserted into the prepunched holes along the length of the stack. The structure and operation of each of these three supports will be addressed in turn.

The coil guide 142 contacts the coil 84 at point 143 along a first sector. As shown in FIG. 2, the coil guide 142 is secured to the bottom housing 36 along the edge of the support surface 60. In order to urge the lead end 122 of the coil 84 through successive prepunched holes in the stack of papers, the coil guide 142 is provided with a series of accurate grooves 182 along the upper surface and inner edge of the coil guide 142 to form a comb with a series of tines 184. The tines 184 are spaced to correspond to the distance between consecutive wraps of the coil 84. According to one feature of the invention, the portion of the coil guide 142 substantially adjacent the coil loading tube assembly 82 preferably includes tines 186 of a reduced height, the significance of which will become apparent upon explanation of the crimping assembly 240 below.

As shown in FIG. 2, the upper comb plate 66, which rests against the upper surface of a stack of sheets when the first lid 38 is closed includes a corresponding series of grooves 188 and tines 190. The upper comb plate 66 further includes a flat recessed area 192 along the end of the comb plate 66, substantially adjacent the loading tube assembly 82. It will be appreciated that when the first lid 38 is closed on a stack of sheets, the recessed area 192 is disposed parallel and substantially adjacent the reduced height tines 186 of the coil guide 142. It will be further be appreciated that as a coil 84 passes through the prepunched openings in a stack of sheets, the lead end 122 and consecutive wraps of the coil progress through the series of grooves 182, 188 in the coil guide 142 and upper comb plate 66.

Returning now to FIGS. 11, 12, and 13, the idler roller 176 contacts the advancing coil 84 at point 177 (see FIG. 12) along the second sector. The idler roller 176 likewise extends the length of the path of which the coil 84 may be advanced. While this second contact surface is preferably in the form of a roller, it may have an alternate shape, such as a contact plate having a curved surface disposed substantially adjacent the coil 84, so long as it provides support to the advancing coil 84 along the second sector. The drive roller 178 contacts the coil along the third and final sector.

Thus, the three contact surfaces, the coil guide 142, the idler roller 176 and drive roller 178, are substantially parallel and spaced along separate one-third sectors about the coil. In the preferred embodiment, however, the left end of the drive roller 178 (as viewed in FIGS. 11 and 13) is slightly closer to the idler roller 176 and comb guide 142 than the right side. In this way, the drive roller 178 exerts a slightly greater torque on the lead edge of the coil 84 as it advances along the edge of the stack of sheets through the prepunched holes. It will thus be appreciated that the three contact surfaces continually guide and direct the lead edge of the coil 84 through the successive prepunched holes to advance the coil through the stack of sheets to minimize any misfeeding of the coil.

Inasmuch as the coil guide 142 is secured to the bottom housing 36, in order to accommodate various sizes of coils 84 for assembly into the stack of sheets, the idler roller 176 and the drive roller 178 are movable with respect to the coil guide 142. The rollers 176, 178, which are rotatably mounted at their ends, may be advanced toward the coil guide 142 to contact the coil 84.

Figure 13:
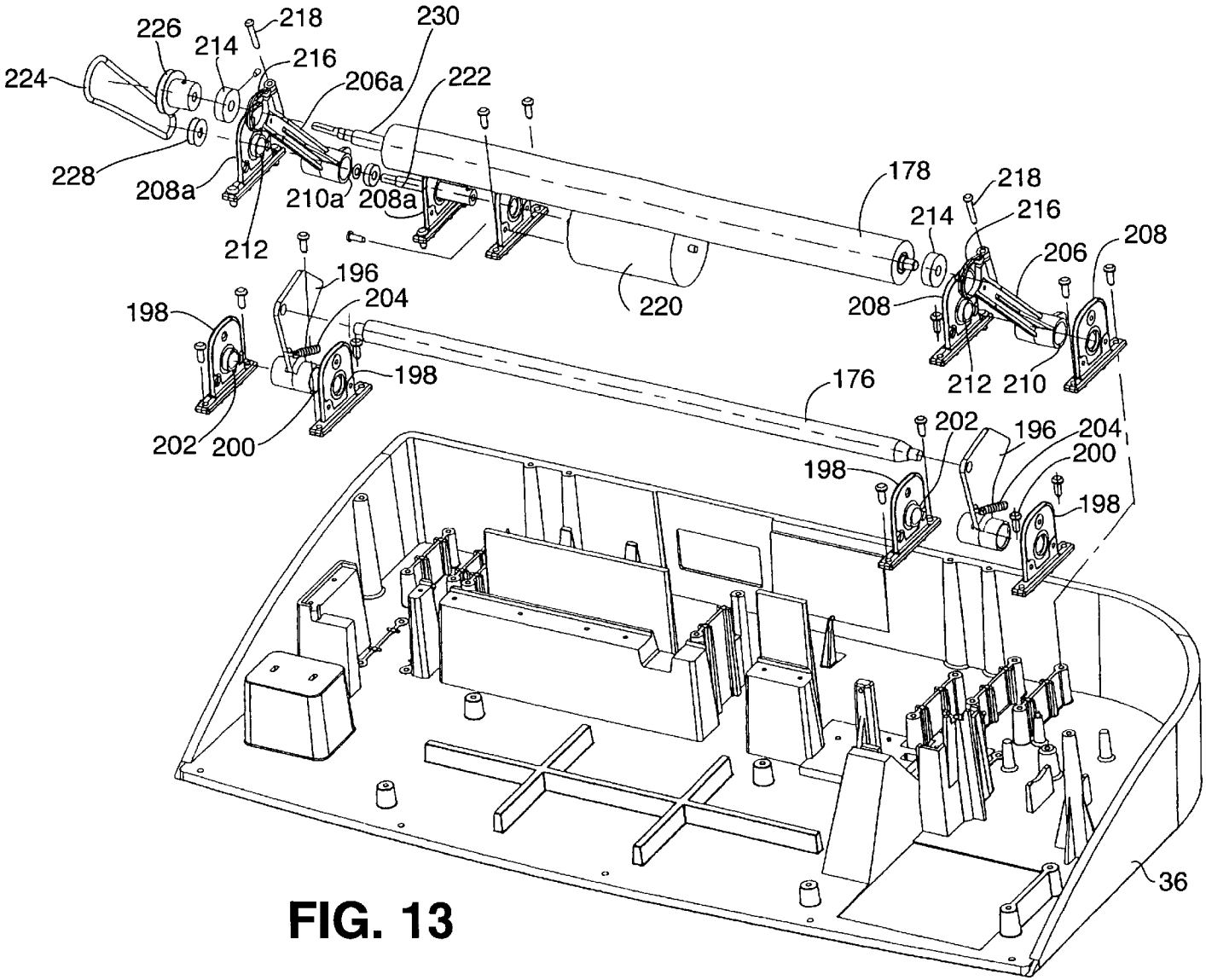
FIG. 13 is an exploded view of the drive assembly of FIG. 11.
Figure 14:
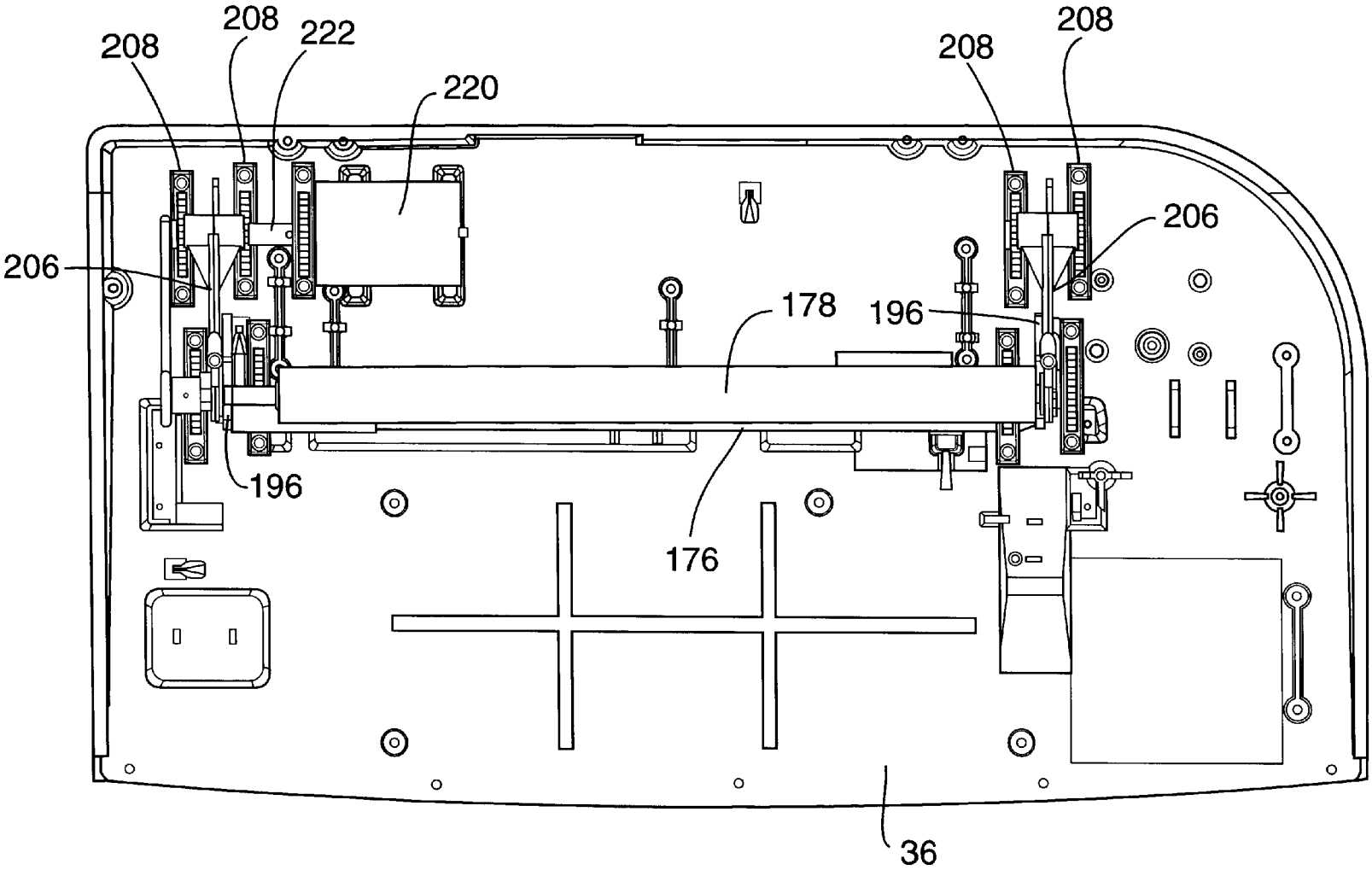
FIG. 14 is an elevational view of the drive assembly of FIG. 11.

As shown in FIG. 13, the idler roller 176 is coupled to the bottom housing 36 by idler roller arms 196 which are pivotally coupled to the bottom housing 36 by upright supports 198. Bores 200 through the idler roller arms 196 receive sleeves 202 extending from the uprights 198. In order to bias the idler roller 176 in the disengaged position, the drive assembly is further provided with springs 204 which bias the arms 196 in a rearward, disengaged position from the coil 84.

The drive roller 178 is similarly coupled to the bottom housing 36 by a pair of drive roller arms 206, 206*a* which are pivotally coupled to the bottom housing 36 by upright supports 208, 208*a*. Sleeves 212, 212*a* extending from the upright supports 208, 208*a* engage bores 210, 210*a* in the ends of the arms 206. In this way, the arms 206 may pivot the drive roller 178 into out of contact with a coil 84, the path of the drive roller 178 being graphically illustrated in FIG. 12 by arrows 194.

In accordance with another aspect of the invention, the drive roller 178 is coupled to the arms 206, 206*a* by means of self aligning bearings 214. As may be seen in FIGS. 12 and 13, the bearings 214 are held in position in the C-shaped end portions 216 of the arms 206, 206*a* by screws 218 extending through the end portions 216.

Figure 9:
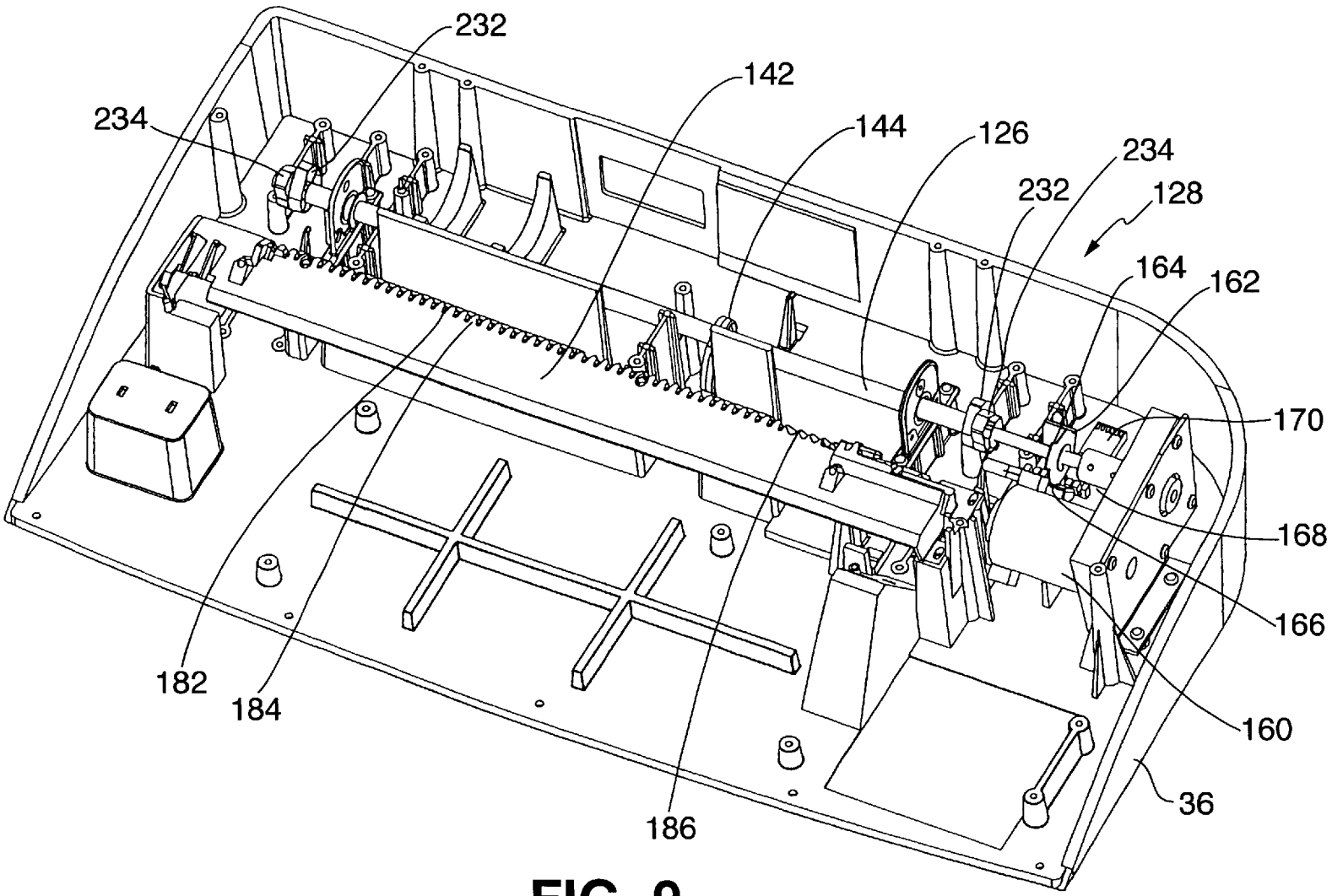
FIG. 9 is a fragmentary perspective view of the automated machine of FIG. 1 showing the cam shaft assembly.
Figure 10:
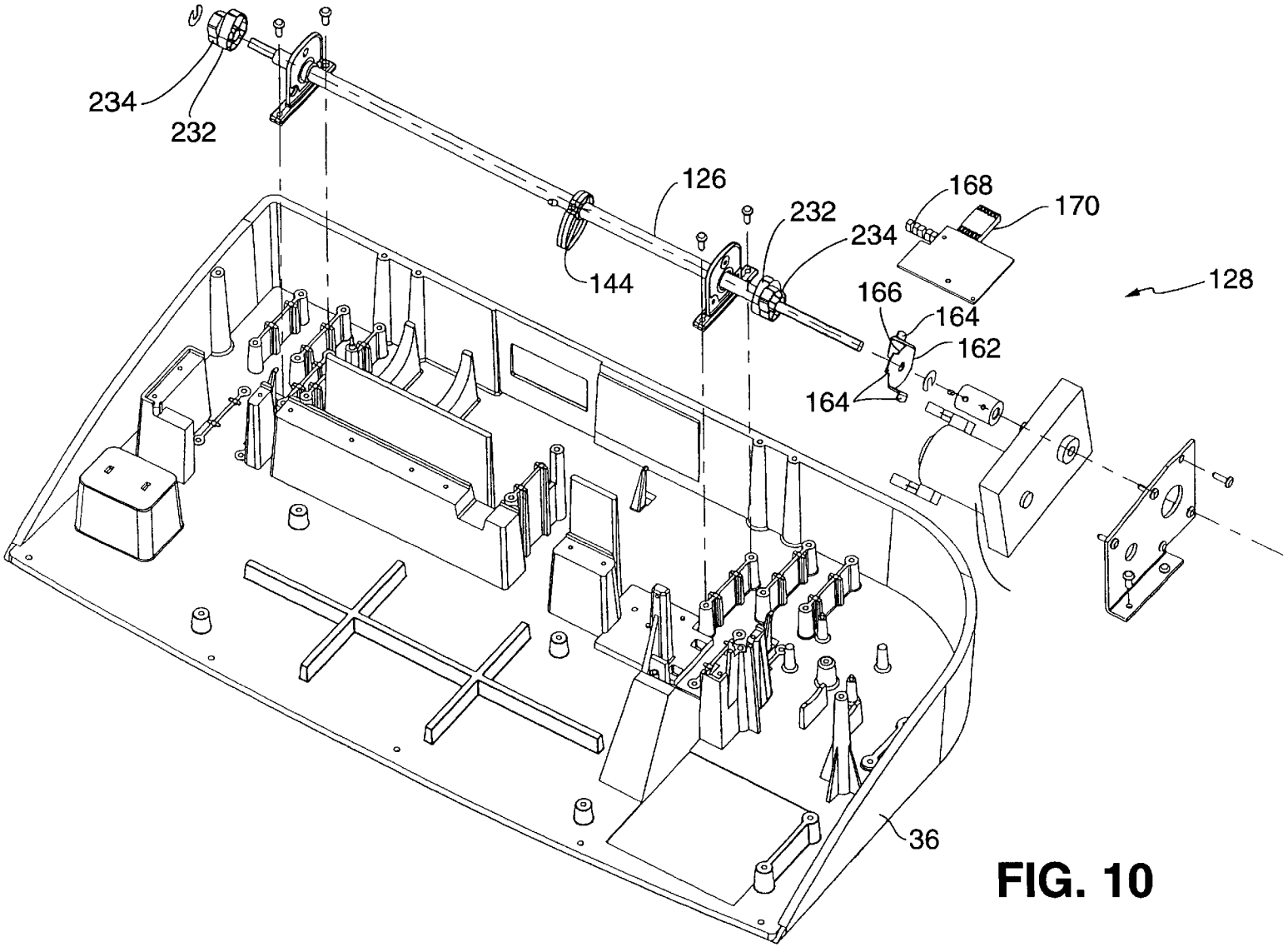
FIG. 10 is an exploded view of the cam shaft assembly of FIG. 9.

In order to properly position the rollers 176, 178 for a loaded coil size, two pairs of cams 232, 234 are provided to contact and position the arms 196, 206, 206*a* supporting the idler roller 176 and drive roller 178 a desired distance toward or away from the coil guide 142, respectively. The cams 232, 234 are secured to the cam shaft 126, as shown in FIGS. 9 and 10. Using the coil size data obtained from the optical sensors 94 coupled to the loading tube 86, the microprocessor 75 provides appropriate data to the gear motor 160. To properly position the cam shaft 126 for a loaded coil size, an optical sensor is provided. A plate 162 having a combination of flags 164 and recesses 166 is secured to the cam shaft 126 for rotation therewith, while the optical sensors 168 are secured to the housing 36 on printed circuit board 170. As the plate 162 rotates, the flags 164 enter recesses of the optical sensor 168. The gear motor 160 rotates the cam shaft 126 to the appropriate position for the coil size loaded as indicated by the microprocessor and optical sensor 170 to set the cams 232, 234 secured to the cam shaft 126 in the proper position. In this way, the idler roller 176 and the drive roller 178 are positioned an appropriate distance from the coil guide 142 to accommodate the particular coil 84 size loaded.

Returning how to FIGS. 11–14, in order to power the drive roller 178, a drive motor 220 is provided. A drive shaft 222 extends from the drive motor 220 through the bore 210*a* and sleeves 212*a* supporting one of the drive roller arms 206*a*. Rotation from the drive motor 220 is further transmitted to the drive roller 178 by means of the belt 224 supported by drive pulleys 226, 228. The distal end of the drive shaft 222 engages the drive pulley 228, while the distal end of the shaft 230 extending from the drive roller 178 engages the drive pulley 226. In this way, rotational motion of the drive shaft 222 is transmitted to the drive roller shaft 230 via the belt 224 to rotate the drive roller 178 and advance a coil 84 through a stack of sheets.

Figure 15:
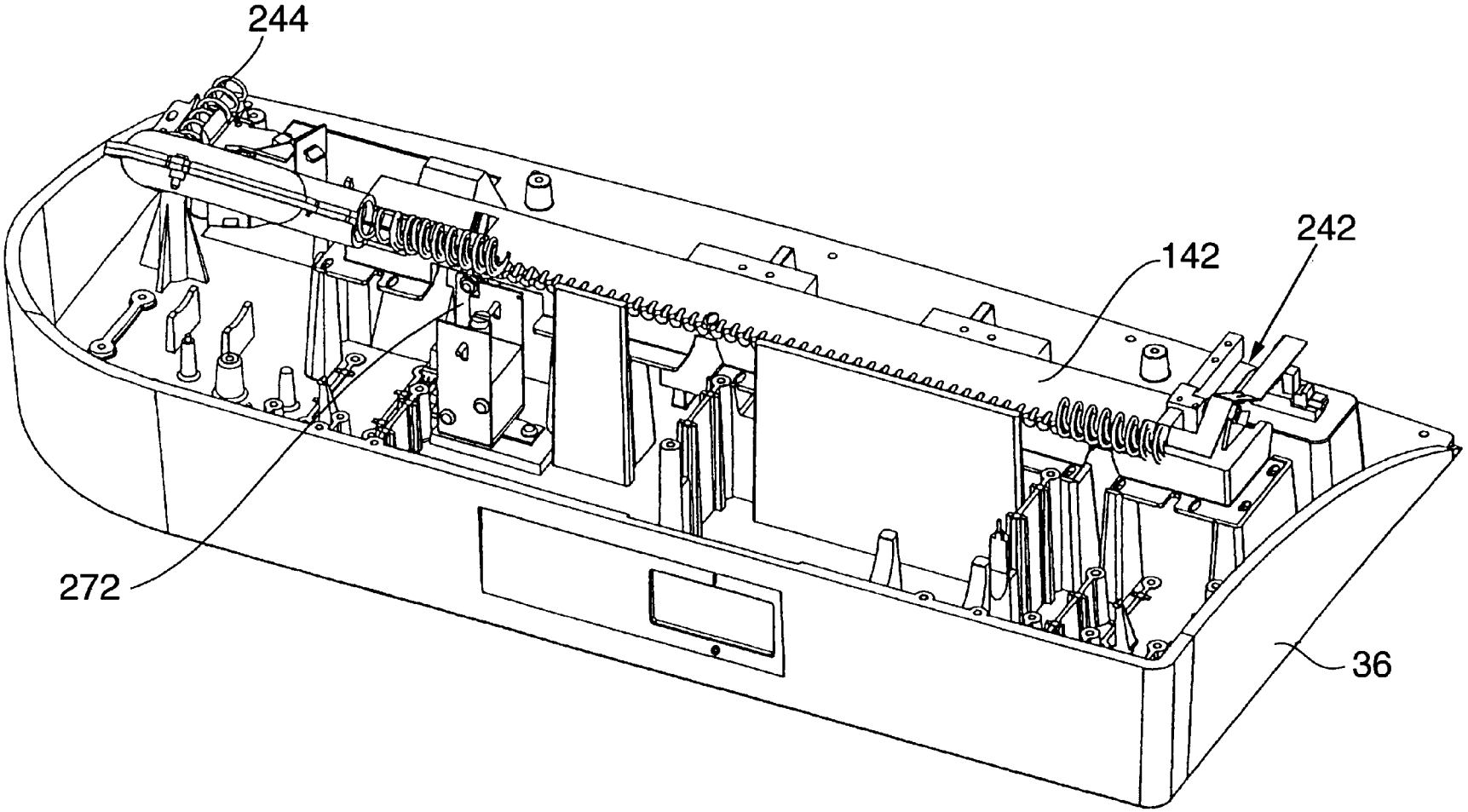
FIG. 15 is a rear perspective view of the coil loading tube assembly of the automated machine of FIG. 1 shown partially broken away wherein segments of a coil are shown for purposes of illustration only.

Turning now to the crimping assemblies 240, 242, that are shown in FIGS. 4 and 15, there is illustrated the coil loading tube assembly 82 (partially broken away in FIG. 15), the coil guide 142, and a pair of crimping assemblies 242, 240 for crimping the lead end and trailing end of the coil 84, respectively. While the right, or trailing end crimping assembly 240 is shown in greater detail, in FIG. 16, the left, or lead end crimping assembly 242 has essentially the same structure and operates in essentially the same manner. Accordingly, only the structure and operation of the right, trailing end crimping assembly 240 will be described in greater detail here.

As may be seen in FIG. 16, the end of the coil 84 is crimped by means of a blade 250 and a pocket in the coil guide 142 (not illustrated in FIG. 16 for clarity). The blade 250 is pivotally mounted by means of a pin 254 such that the edge 256 of the blade 250 may pivot forward and into the coil guide 142. Accordingly, as the end of the coil 84 moves through the coil guide 142, the blade 250 is actuated to pivot the edge 256 toward the coil 84 to bend the coil 84 into the pocket formed in the coil guide 142. In this way, the mechanism bends or crimps the end of the coil 84 to prevent it from winding through the prepunched holes of the stack of papers.

As shown in FIG. 4, the pivoting movement of the blade 250 is accomplished by means of a four-bar type linkage and a solenoid 260. The solenoid 260 is coupled to the blade 250 by means of the actuation rod 262 and link 264. The link 264 is pivotably coupled to both the blade 250 and actuation rod 262, and is biased in the position illustrated in FIG. 4 by means of a spring 266.

Actuation of the crimping assemblies 240, 242 by the solenoids 260, 286 occurs when a coil 84 trips a number of sensors indicating the coil 84 position. As the coil 84 feeds through the stack of sheets, the trailing end 244 of the coil, passes over the actuated whaleback flag 252 and sensor 120, which then returns to its original non-actuated position. This movement of the whaleback sensor 120 causes the microprocessor 75 to signal the motor break (not visible) of the drive motor 220 (see FIGS. 12–14) to stop the drive motor 220. The motor 220 then turns on to a slow speed to slowly walk the coil 84 forward through the prepunched holes.

As the trailing end 244 of the coil 84 passes the right end of the coil lever 272 (see FIGS. 15 and 16), the biasing slave spring 274 allows the coil lever 272 to snap to its home position. This movement of the coil lever 272 trips the sensor 275 which provides a signal to the microprocessor 75, which in turn indicates to the motor 220 to stop, discontinuing the slow forward movement of the coil 84. At this point, the trailing end 244 of the coil 84 is disposed adjacent the coil guide 142 of the trailing end crimping assembly 240.

The right solenoid 260 is then fired to pivot the blade edge 256 into contact with and bend the coil 84 into the crimp pocket of the coil guide 142 to crimp the trailing end 244.

After the trailing end crimp assembly 240 is fired, the motor drive 220 again engages to rotate the drive roller 178 to drive the coil 84 forward through the remainder of the prepunched holes in the stack of sheets. It will be appreciated that at this point, the trailing end 244 of the coil 84 is already crimped but moves easily over the reduced height tines 186 of the coil guide 142 and the recessed area 192 of the upper comb plate 66 (see FIG. 2).

As shown in FIG. 4, as the lead end 122 of the coil 84 progresses through the prepunched holes, the lead end 122 moves forward until such time as it contacts and actuates a lever 278 as shown in FIG. 4. As the lever 278 is actuated, it pivots to move a flag 280 into an optical sensor 282. The optical sensor 282 provides a signal to the microprocessor 75, which directs the drive motor 220 to shut off. The second solenoid 286 is then fired to pivot the blade 288 to crimp the lead end 122 of the coil 84.

The user may then lift the first lid 38 to access the bound book. A lid closed sensor is provided to signal whether the first lid 38 is lifted or closed. After lid 38 is lifted, the lid closed sensor 65 provides a signal to the microprocessor 75 which directs the motor 220 to reverse the rotational direction of the drive roller 178 momentarily to back the crimped lead end 122 of the coil 84 out of the lead end crimping assembly 242. The micro processor likewise directs the cam shaft 126 to return to its home position to the move the pins 64 to the upright engaged position shown in FIG. 7 and to move the idler and drive rollers 176, 178 to their home, disengaged positions. In this way, the bound book is kicked out slightly toward the user.

Thus, the invention provides a personal machine that may be used to feed a spiral coil through prepunched holes in a stack of sheets either manually or automatically. The operation of the machine is preferably controlled by a microprocessor 75. Should the user wish to bind a stack of sheets automatically, the user lifts the first lid 38, and places the stack of sheets on the support surface 60, positioning holes through the prepunched stack over the upright tines 64 such that the stack is dispersed adjacent the wall 62 (FIG. 2). Upon closing the lid, sensors 65, 74 provide signals to the microprocessor 75 indicating that the sheets are present and the height of the stack. Using this information, the microprocessor 75 sends a signal to illuminate one of the display lights 78 of display assembly 76 indicating the minimum diameter coil required to bind the stack.

The user then inserts a coil into the entry port 80 and through the loading tube 88. As the coil moves through the loading tube, it contacts the widen surface 100 of the size indication lever 92, pivoting the lever 92 through sensors 94 which provide a signal to the microprocessor 75 indicating the size of the coil 84 loaded into the tube 88 (FIGS. 4 and 5). The microprocessor 75 compares the signal indicating the actual coil size loaded with the minimum coil size required as determined by the sensor 74. If the actual loaded coil 84 side is smaller than required to bind the stack, a light 78 indicating such will illuminate.

As the coil 84 is pushed through the loading tube 86, the coil contacts the orientation bend 112 which consistently biases the coil 84 against one edge 114 of the loading tube 86 as the coil 84 emerges from the outlet 110. The user then continues to push the coil 84 slightly to move the lead end 122 of the coil 84 below a locating finger 124 and onward to actuate the whaleback sensor 120. If the coil size is as required or larger than required, the ready light 78 on the display 76 will illuminate when the coil is in position.

When the ready light 78 is illuminated, the user may depress the start button 79 to initiate the automatic binding process. The microprocessor 75 then provides a signal to the gear motor 160 which rotates the cam shaft 126 to rotate a series of cams 144, 232, 234 secured thereto which engage the pin assembly 130, and the arms 196, 206, **206*a* of the idler roller 176 and drive roller 178. As the cam shaft 126 rotates, the cam 144 and spring 148 of the pin assembly cause the pins 64 to disengage from the prepunched holes. The gear motor 160 then continues to rotate the cam shaft 126 to position the cams 232, 234 in an appropriate position for the size of coil 84 loaded into the coil loading tube 88. The degree which the cam shaft 126 is rotated is determined by the flag plate 162 and optical sensors 170 coupled to the shaft 126**.

Once the idler roller 176 and drive roller 178 are in the appropriate position for pulling the coil through the prepunched holes, the microprocessor 75 engages the drive motor 220 to rotate the drive roller 178 to advance the coil 84 through the series of prepunched holes.

As the coil 84 is pulled through the holes in the stack, the trailing end 244 of the coil 84 moves over the whaleback sensor 120. The whaleback sensor returns to its original position, signaling a motor break to stop the drive motor 220 and, accordingly, rotation of the drive roller 178. The microprocessor 75 then signals the drive motor 220 to turn the drive roller 178 at a slow speed and slowly walk the coil 84 forward through the prepunched holes. As the trailing end 244 of the coil passes the coil lever 272, the lever trips a sensor 275 provides a signal to the microprocessor 75 which in turn indicates to the motor 220 to stop, which halts the forward movement of the coil 84. The microprocessor 75 then actuates the solenoid 260 which pivots the edge 256 of the crimping blade 250 into contact with the trailing end of coil 244 of the plastic coil 84 disposed within the crimping pocket of the coil guide 142 to crimp the trailing end 244 of the coil 84.

The microprocessor 75 then engages the drive motor 220 to rotate the drive roller 178 to continue to drive the coil 84 through the prepunched holes and into the lead end crimping assembly 242. When the lead end 122 of the coil 84 moves into the lead end crimping pocket of the coil guide 142, it contacts a lever 276 which pivots a flag 280 to trip an optical sensor 282. The signal from the optical sensor 282 provides the signal to the microprocessor 75 which directs the motor to shut off. The microprocessor 75 then fires the left solenoid 286 to crimp the lead end 122 of the coil 84.

As the user then lifts the first lid 78, the lid 78 trips a sensor which causes the microprocessor 75 to reverse the drive motor 220 to back the crimped lead end 122 of the coil 84 out of the crimp station and kick the book out slightly. The microprocessor 75 then directs the cam shaft 126 to return to its home position, engaging the cam 144 with the pin shaft assembly 122 to return the pins to their upright position and the idler and drive rollers 176, 178 to return to their home, disengaged positions.

In this way, the user may employ the machine to insert a coil and crimp the ends to provide a spirally bound book. Alternately, should the user wish to manually insert a coil through a prepunched stack, the user merely lifts the second lid 40 to access the drive roller 178, which is in its home, disengaged position (FIGS. 3, 11, and 12). When the second lid is opened, the microprocessor 75 directs the drive motor 220 to engage to rotate the drive roller 178. After manually feeding the lead end 122 of a coil through the first few prepunched holes, the user may then hold the coil against the rotating drive roller 178 to pull the coil through the holes. The user may then manually crimp the ends of the coil.

In summary, the invention provides a compact, personal binding machine which may be used to bind a book either manually or automatically. The machine is user-friendly and easy to operate, providing a series of indication and direction lights along its upper surface. Moreover, during automatic operation, once the paper and coil are loaded, the machine automatically inserts the coil and crimps its ends without further interaction by the user. Features such as the loading tube, which comprises an orientation bend to properly position the coil for insertion, the three contact surface drive assembly, and the unique crimping assembly provide consistent and reliable book binding.

We claim as our invention:

1. An automated machine for spirally binding a coil into a stack of sheets having prepunched holes along a side edge thereof, said machine comprising, in combination:

a support surface adapted to support the stack of sheets and having an edge adapted to be positioned substantially adjacent the prepunched holes;

a rotatable drive roller for engaging said coil and spirally feeding said coil lengthwise through said prepunched holes, said drive roller being disposed substantially parallel the edge and extending substantially the entire length of said stack of sheets;

a drive system for rotating said drive roller;

a housing assembly, said rotatable drive roller being disposed within said housing assembly, said housing assembly having a first opening adjacent to the support surface and a second elongated opening substantially adjacent and parallel to the drive roller, said second elongated opening being spaced from the support surface and the first opening, whereby a user may access the drive roller through the second elongated opening to manually insert a coil which has been inserted into the first prepunched hole into a stack of sheets by holding the coil against the drive roller.

2. The automated machine of claim 1 wherein the housing assembly comprises a housing and a cover, the housing including the second elongated opening, the cover being disposed substantially adjacent the elongated opening and being adapted to cover the second elongated opening, said cover being moveable relative to the housing to allow a user to access the drive roller.

3. The automated machine of claim 2 wherein the cover is pivotably coupled to the housing such that the cover may be pivoted away from the housing to allow access to the drive roller.

4. An automated binding machine for spirally binding a coil into a stack of sheets having prepunched holes along a side edge thereof, said machine comprising:

a support surface adapted to support the stack of sheets for binding;

an elongated coil guide defining a lengthwise series of slots for positioning the spirals of the coil, said elongated coil guide being disposed along an edge of the support surface;

an elongated guide member, a rotatable drive roller for engaging said coil and spirally feeding said coil lengthwise through said coil guide;

said elongated coil guide, said elongated guide member and said rotatable drive roller being disposed about the outer periphery of the coil and adapted to contact the coil along its outer surface at three lines of contact prior to the time the coil engages the prepunched holes along the side edge of the stack of sheets supported on the support surface, said lines of contact being substantially parallel;

a drive system for rotating said drive roller to drive the coil into the prepunched holes.

5. The automated machine of claim 4 wherein the elongated coil guide, the rotatable drive roller and the elongated guide member extend substantially the entire length of the stack of sheets.

6. The automated machine of claim 4 wherein the elongated coil guide includes a series of grooves and tines extending along an elongated edge of said coil guide, said grooves being spaced to correspond to successive wraps of the coil.

7. The automated machine of claim 4 wherein the rotatable drive roller is adapted to move toward or away from the coil guide to accommodate the feeding of coils having varied diameters.

8. The automated machine of claim 7 further comprising at least one drive roller arm, the rotatable drive roller being mounted by the at least one drive roller arm to move the drive roller toward or away from the coil guide.

9. The automated machine of claim 8 further comprising self-aligning bearings, said self-aligning bearings coupling the rotatable drive roller to the at least one drive roller arm.

10. The automated machine of claim 8 further comprising at least one guide member arm, the elongated guide member being mounted by the at least one guide member arm to move the guide member toward or away from the coil guide to accommodate the feeding of coils having varied diameters, the automated machine further comprising at least one drive cam having a peripheral surface, at least one guide cam having a peripheral surface, and a cam shaft for rotating said at least one drive cam and at least one guide cam, said at least one drive cam and at least one guide cam being disposed on said cam shaft for rotation therewith, said at least one drive roller arm being disposed to contact the peripheral surface of the at least one drive cam and said at least one guide arm being disposed to contact the peripheral surface of said at least one guide cam such that rotation of the cam shaft controls movement of the drive roller and the elongated guide member toward or away from the elongated coil guide.

11. The automated machine of claim 7 wherein the rotatable drive roller is adapted to move to a first distance away from the coil guide to accommodate a first coil having a first diameter, and a second distance away from the coil guide to accommodate a second coil having a second diameter.

12. The automated machine of claim 7 further comprising at least one cam, and a cam shaft for rotating said at least one cam, the movement of the rotatable drive roller toward or away from the coil guide being controlled by rotation of said at least one cam.

13. The automated machine of claim 7 wherein the guide member is adapted to move the guide member toward or away from the coil guide to accommodate the feeding of coils having varied diameters.

14. The automated machine of claim 13 further comprising at least one guide member arm, the guide member being mounted by the at least one guide member arm to move the guide member toward or away from the elongated coil guide and at least one drive roller arm, the rotatable drive roller being mounted by at least one drive roller arm to move the drive roller toward or away from the elongated coil guide.

15. The automated machine of claim 7 further comprising a crimper for deforming an end of the coil to prevent it from passing through the prepunched holes of said stack of sheets, said crimper including a cradle having a recess and a blade having an edge, the cradle being disposed to receive the end of the coil substantially adjacent the recess, and the blade being disposed to contact the coil to bend the coil into the recess.

16. The automated machine of claim 15 further comprising a solenoid coupled to the blade, the blade being moveably mounted to advance the edge into the recess, whereby actuation of the solenoid causes the edge of the blade to contact the coil to bend the coil into the recess.

17. The automated machine of claim 7 further comprising a loading tube for receiving a coil to be advanced into a position substantially adjacent the elongated coil guide, and a coil size indicator disposed within the loading tube for indicating the size of coil loaded into the loading tube, the distance that the rotatable drive roller moves toward or away from the coil guide corresponding to the coil size loaded into the loading tube.

18. The automated machine of claim 4 wherein the elongated guide member is a roller.

19. The automated machine of claim 4 wherein the elongated guide member has a substantially arcuate surface.

20. The automated machine of claim 4 wherein the guide member is adapted to move toward or away from the coil guide to accommodate the feeding of coils having varied diameters.

21. The automated machine of claim 20 further comprising at least one guide member arm, the rotatable drive roller being mounted by the at least one guide member arm to move toward or away from the coil guide.

22. The automated machine of claim 4 further comprising at least one crimper for deforming an end of the coil to prevent it from passing through the prepunched holes of said stack of sheets.

23. The automated machine of claim 22 wherein the crimper includes a cradle having a recess and a blade having an edge, the cradle being disposed such that the end of the coil is substantially adjacent the recess, and the blade being disposed to contact the coil to bend the coil into the recess.

24. The automated machine of claim 23 further comprising a solenoid coupled to the blade, whereby actuation of the solenoid causes the blade to contact the coil to bend the coil into the cradle recess.

25. The automated machine of claim 23 wherein the blade is pivotably mounted such that the blade pivots into contact with the coil to crimp the coil.

26. The automated machine of claim 4 further comprising a loading tube having a bore with an inside surface for positioning the coil adjacent the elongated coil guide, said loading tube comprising an orientation bend whereby the coil entering the feed tube is biased against a portion of the inside surface substantially adjacent the elongated coil guide, such that the drive roller and the elongated guide member may contact the coil to advance it into the holes.

27. The automated machine of claim 4 further comprising a loading tube for receiving a coil to be advanced into a position substantially adjacent the elongated coil guide, and a coil size indicator disposed within the loading tube for indicating the size of coil loaded into the loading tube.

28. The automated machine of claim 27 wherein the coil size indicator includes a pivotably mounted lever and an optical sensor.

29. The automated machine of claim 27 further comprising a thickness indicator for measuring the thickness of the stack of papers to be bound.

30. The automated machine of claim 4 further comprising a thickness indicator for measuring the thickness of the stack of papers to be bound.

31. An automated machine for spirally binding a coil into a stack of sheets having prepunched holes along a side edge thereof, said machine comprising, in combination:

an elongated coil guide for positioning the spirals of the coil to be fed into the prepunched holes;

a rotatable drive roller for engaging said coil and spirally feeding said coil lengthwise through said coil guide, said drive roller being disposed substantially parallel the coil guide;

a drive system for rotating said drive roller;

a loading tube for positioning the coil adjacent the coil guide, said loading tube comprising a bore with an inside surface, said loading tube further comprising an orientation bend whereby the coil entering the loading tube abuts the inside surface and is biased against a portion of the inside surface substantially adjacent the elongated coil guide, such that the drive roller may contact the coil as it emerges from the bore to advance the coil into the holes.

32. The automated machine of claim 31 further comprising a housing, the elongated coil guide, the rotatable drive roller and the feed tube being disposed substantially within the housing, the loading tube including an entry port, the entry port opening through the housing.

33. The automated machine of claim 32 wherein the housing includes a front portion, and the entry port opens through the front portion.

34. The automated machine of claim 32 wherein the loading tube assembly further comprises a second bend, the second bend disposed such that the coil entering the loading tube through the entry port contacts the second bend prior to contacting the orientation bend.

35. A method of operating an automated binding and crimping machine to spirally bind a coil into a stack of sheets having prepunched hole along an edge of the sheets and crimp at least one end of the coil, the method including the steps of:

positioning the stack of sheets on a support surface having an elongated coil guide along an elongated edge of the support surface, positioning the coil substantially adjacent an end of the elongated coil guide, activating a switch to initiate an automated binding and crimping process the automated binding and crimping process requiring no further interaction by the user, the automated binding and crimping process including the steps of:

advancing a drive roller into a position substantially parallel the elongated coil guide to accommodate the coil, engaging a drive motor to rotate the drive roller, advancing the coil through the prepunched holes, guiding the coil through the prepunched holes using the elongated coil guide, the drive roller and an elongated guide member, and crimping an end of the coil.

36. The method of claim 35 further comprising the step of positioning the stack of sheets over at least one locator pin.

37. The method of claim 35 further comprising the step of measuring the thickness of the stack of sheets positioned on the support surface.

38. The method of claim 35 wherein the step of positioning the coil includes the step of advancing the coil through a coil loading tube to a position substantially adjacent the end of the elongated coil guide.

39. The method of claim 35 wherein the step of advancing the drive roller includes the step of rotating a cam to move the drive roller toward the coil guide.

40. The method of claim 35 further comprising the step of advancing the elongated guide member toward the elongated coil guide.

41. The method of claim 35 wherein the step of crimping an end of the coil further comprising the step of advancing a blade into contact with the end to bend the end into a recess.

42. The method of claim 41 further comprising the steps of sensing when the end of the coil is disposed adjacent the recess, disengaging the drive motor, and actuating the crimping assembly.

43. The method of claim 35 further comprising the steps of sensing when the end of the coil is disposed adjacent a crimping assembly, and disengaging the drive motor.

44. A method of operating an automated binding machine to spirally bind a coil into a stack of sheets having prepunched hole along an edge of the sheets, the method including the steps of:

positioning the stack of sheets on a support surface having an elongated coil guide along an elongated edge of the support surface, advancing the coil through a coil loading tube to a position substantially adjacent the end of the elongated coil guide, sensing the size of coil advanced into the coil loading tube, advancing a drive roller into a position substantially parallel the elongated coil guide to accommodate the coil, engaging a drive motor to rotate the drive roller, advancing the coil through the prepunched holes, guiding the coil through the prepunched holes using the elongated coil guide, the drive roller and an elongated guide member, crimping an end of the coil.

45. The method of claim 44 further comprising the step of comparing the size of coil to the thickness of the stack of sheets positioned on the support surface.

46. The method of claim 45 further comprising the step of illuminating a display light if the size of the coil advanced into the loading tube is too small to bind the stack of sheets.

47. The method of claim 45 further comprising the step of illuminating a ready light if the size of the coil advanced into the loading tube is large enough to bind the stack of sheets.

48. The method of claim 45 wherein the step of advancing the drive roller includes the step of rotating a cam an amount required to advance the drive roller to a distance from the coil guide required to accommodate the size coil loaded into the loading tube assembly.

49. The method of claim 44 wherein the step of advancing the drive roller includes the step of rotating a cam an amount required to advance the drive roller to a distance from the coil guide required to accommodate the size coil loaded into the loading tube assembly.

50. A method of operating an automated binding machine to spirally bind a coil into a stack of sheets having prepunched hole along an edge of the sheets, the method including the steps of:

positioning the stack of sheets on a support surface having an elongated coil guide along an elongated edge of the support surface, positioning the coil substantially adjacent an end of the elongated coil guide, advancing a drive roller into a position substantially parallel the elongated coil guide to accommodate the coil, engaging a drive motor to rotate the drive roller, advancing the coil through the prepunched holes, guiding the coil through the prepunched holes using the elongated coil guide, the drive roller and an elongated guide member, disengaging the drive motor, crimping a trailing end of the coil, engaging the drive motor, advancing a leading end of the coil through the coils, and crimping the leading end of the coil.

* * * * *